US005958637A

United States Patent [19]

Morishita et al.

[11] Patent Number: 5,958,637

[45] Date of Patent: Sep. 28, 1999

[54] ELECTROPHOTOGRAPHIC PHOTORECEPTOR AND COATING SOLUTION FOR PRODUCTION OF CHARGE TRANSPORT LAYER

[75] Inventors: Yoshii Morishita, Hitachi; Takayuki Akimoto, Tsukuba; Megumi Matsui, Hitachi; Shigeru Hayashida, Tsukuba; Susumu Sakio, Hitachi, all of Japan

[73] Assignee: Hitachi Chemical Company, Ltd., Tokyo, Japan

[21] Appl. No.: 08/899,268

[22] Filed: Jul. 23, 1997

[30] Foreign Application Priority Data

Jul. 24, 1996 [JP] Japan ..... 8-194226

[51] Int. Cl.[6] ..... G03G 5/047

[52] U.S. Cl. ..... 430/59

[58] Field of Search ..... 430/59

[56] References Cited

U.S. PATENT DOCUMENTS

| | | | |
|---|---|---|---|
| 4,877,702 | 10/1989 | Miyakawa et al. | 430/59 |
| 5,160,487 | 11/1992 | Morishita et al. | 430/59 |
| 5,725,986 | 3/1998 | Grammatica et al. | 430/59 |

FOREIGN PATENT DOCUMENTS

| | | | |
|---|---|---|---|
| 0092255 | 10/1983 | European Pat. Off. . | |
| 0390196A2 | 3/1990 | European Pat. Off. . | |
| 0390196A3 | 3/1990 | European Pat. Off. . | |
| 0475676 | 9/1991 | European Pat. Off. . | |
| 47-18543 | 9/1972 | Japan . | |
| 47-18544 | 9/1972 | Japan . | |
| 47-37543 | 12/1972 | Japan . | |
| 47-37544 | 12/1972 | Japan . | |
| 48-43942 | 6/1973 | Japan . | |
| 48-70538 | 9/1973 | Japan . | |
| 49-1231 | 1/1974 | Japan . | |
| 49-105536 | 10/1974 | Japan . | |
| 50-75214 | 6/1975 | Japan . | |
| 53-44028 | 4/1978 | Japan . | |
| 54-17732 | 2/1979 | Japan . | |
| 55-7940 | 1/1980 | Japan . | |
| 55-42380 | 10/1980 | Japan . | |
| 58-32372 | 7/1983 | Japan . | |
| 58-182640 | 10/1983 | Japan . | |
| 58-198043 | 11/1983 | Japan . | |
| 59-9049 | 2/1984 | Japan . | |
| 59-44054 | 3/1984 | Japan . | |
| 59-49544 | 3/1984 | Japan . | |
| 59-166959 | 9/1984 | Japan . | |
| 61-132955 | 6/1986 | Japan . | |
| 61-295558 | 12/1986 | Japan . | |
| 62-194257 | 8/1987 | Japan . | |
| 62-237458 | 10/1987 | Japan . | |
| 1-142641 | 6/1989 | Japan | 430/59 |
| 2-198452 | 8/1990 | Japan . | |
| 2-256059 | 10/1990 | Japan . | |
| 5-6010 | 1/1993 | Japan . | |
| 6-175382 | 6/1994 | Japan . | |
| 6-271786 | 9/1994 | Japan . | |
| 8-41373 | 2/1996 | Japan . | |

OTHER PUBLICATIONS

Inorg. Chem. 1980, 19, 3131–3135, "Studies of a Haloaluminum, –galliium. and –indium Phthalocyanines" By J.P. Linsky et al.

Database WPI Section Ch, Week 8928 Derwent Publication Ltd., London, GB; Class A89, AN 89–203379 XP002046007 & JP 01 142 641 (Fujitsu Ltd), Jun. 5, 1989.

Database WPI Section Ch, Week 9426 Derwent Publication Ltd., London, GB; Class E14, AN 94–211983 XP002046027 & JP 06 148 917 A (Hitachi Chem Co Ltd), May 27, 1994.

*Primary Examiner*—Roland Martin

*Attorney, Agent, or Firm*—Griffin, Butler, Whisenhunt & Szipl, LLP

[57] ABSTRACT

An electrophotographic photoreceptor comprising a conductive support and a photosensitive layer which comprises a charge generation layer containing a charge generation material and a charge transport layer containing a charge transport material, the charge generation material comprising a phthalocyanine composition (A) which comprises a phthalocyanine, and the charge transport material comprising a benzidine derivative (B) represented by the following general formula (I)

(I)

wherein each $R^1$ independently is a halogen atom, an alkyl group, an alkoxy group, an aryl group, a fluoroalkyl group or a fluoroalkoxy group, each $R^2$ independently is hydrogen atom or an alkyl group, m is an integer of 0 to 5, and when m is an integer of 2 to 5, the groups $R^1$ are identical with or different from each other, and a coating solution for production of charge transport layers which contains the benzidine derivative (B).

23 Claims, 8 Drawing Sheets

ELECTROPHOTOGRAPHIC PHOTORECEPTOR AND COATING SOLUTION FOR PRODUCTION OF CHARGE TRANSPORT LAYER

BACKGROUND OF THE INVENTION (a) Field of the invention

The present invention relates to electrophotographic photoreceptors and coating solutions for production of charge transport layers.

(b) Description of Related Art

A conventional type of electrophotographic photoreceptors are "Se" photoreceptors produced by vacuum evaporating a selenium (Se) coating of about 50 μm thick onto a conductive support, such as an aluminum support, which however suffer at least from their limited sensitivity only to lights of about 500 nm or less in wavelength.

Another conventional type of photoreceptors have, on a Se layer of about 50 μm thick disposed on a conductive support, an additional selenium-tellurium (Se-Te) alloy layer. They can be made spectrally sensitive to longer wavelengths by increasing the Te content in the Se-Te alloy layer, but suffer from the serious disadvantage that they lose the ability of keeping charge on surfaces as the Te content increases, to be inapplicable to practical use.

Further, there are so-called composite-two-layer-type photoreceptors, which contain, on an aluminum support, an about 1 μm thick charge generation layer which is a coating of chlorocyane blue or a squalilium acid derivative, and, on the charge generation layer, an about 10 to 20 μm thick charge transport layer which is a coating of a mixture of polyvinylcarbazole having high insulating resistance or a pyrazoline derivative and polycarbonate resin. They, however, are not sensitive to lights of 700 nm or more.

As improvements of the composite-two-layer-type photoreceptors, there have recently been proposed various photoreceptors sensitive to lights of around 800 nm which range is the oscillation region of semiconductor lasers. Many of these composite-two-layer-type photoreceptors have an about 0.5 to 1 μm thick charge generation layer containing a phthalocyanine pigment as a charge generation material and, thereon, a charge transport layer which is an about 10 to 20 μm thick coating of a mixture comprising polyvinylcarbazole, a pyrazoline derivative or a hydrazone derivative and polycarbonate resin or polyester resin and having high insulating resistance.

Examples of known charge transport materials used in charge transport layers are hydrazone derivatives disclosed in Japanese Patent Application Examined Publication No. 55-42380 (1980), enamine derivatives disclosed in Japanese Patent Application Unexamined Publication No. 62-237458 (1987), benzidine derivatives disclosed in Japanese Patent Application Examined Publication No. 59-9049 (1984) and Japanese Patent Application Unexamined Publication Nos. 55-7940 (1980) and 61-295558 (1986), stilbene derivatives disclosed in Japanese Patent Application Unexamined Publication No. of 58-198043 (1983) and triphenylamine derivatives disclosed in Japanese Patent Application Examined Publication No. 58-32372 (1983) and Japanese Patent Application Unexamined Publication No. 61-132955 (1986).

Known benzidine derivatives include N,N,N',N'-tetraphenylbenzidine, N,N'-diphenyl-N,N'-bis(3-methylphenyl)benzidine, N,N,N',N'-tetrakis(4-methylphenyl)benzidine, N,N'-diphenyl-N,N'-bis(4-methoxyphenyl)benzidine and N,N,N',N'-tetrakis(4-methylphenyl)tolidine. These benzidine derivatives transport charge relatively efficiently, but have poor solubility in organic solvents and are easily oxidized. Due to the poor solubility, the benzidine derivatives sometimes make it difficult to prepare coating solutions for the production of charge transport layers, or are crystallized during coating. Even if the charge transport layers visually have a good appearance, the benzidine derivatives in the charge transport layers deposit as fine crystals, to deteriorate image quality.

To solve these problems, in Japanese Patent Application Unexamined Publication No. 5-6010 (1993) are proposed electrophotographic photoreceptors of high sensitivity and good image characteristics, which contain new fluorine-containing N,N,N',N'-tetraarylbenzidine derivatives having good solubility in organic solvents and excellent compatibility with binders, such as polycarbonate resins.

However, electrophotography, typically in laser beam printers, is being advanced in image quality and resolution, requiring electrophotographic photoreceptors having higher sensitivity, lower residual potential and better image quality.

Charge generation materials which have been used in combination with these charge transport materials include metal-free phthalocyanines and metallo-phthalocyanines, such as copper phthalocyanine, chloroaluminum phthalocyanine, chloroindium phthalocyanine, titanyl phthalocyanine and vanadyl phthalocyanine.

Phthalocyanines differ from each other in absorption spectrum and photoconductivity according not only to the kinds of central metals but also to the crystal structures thereof. There are some reports of selecting ones of specific crystal structures for electrophotographic photoreceptors from phthalocyanines containing the same central metal.

For example, there are various titanyl phthalocyanines of different crystal structures, which are reported to be largely differ in charging efficiency, dark decay ratio (herein, "dark decay ratio" means the ratio of a surface potential remaining after standing in the dark to an initial surface potential before the standing) and sensitivity depending on their crystal structures.

In Japanese Patent Application Unexamined Publication No. 59-49544 (1984), a titanyl phthalocyanine of a crystal structure which has a diffraction spectrum indicating intense peaks at Bragg angles (2θ±0.2°) of 9.2°, 13.1°, 20.7°, 26.2° and 27.1° is described to be desirable, with an X-ray diffraction spectrum thereof shown therein. An electrophotographic photoreceptor produced by using this titanyl phthalocyanine as a charge generation material has a dark decay ratio (DDR) of 85% and a sensitivity ($E_{1/2}$) of 0.57 lux·sec.

In Japanese Patent Application Unexamined Publication No. 59-166959 (1984) is disclosed a charge generation layer produced by allowing a deposition layer of titanyl phthalocyanine to stand in a saturated vapor of tetrahydrofuran to change its crystal structure. Its X-ray diffraction spectrum shows a decreased number of widened peaks and indicates intense diffraction peaks at Bragg angles (2θ±0.2°) of 7.5°, 12.6°, 13.0°, 25.4°, 26.2° and 28.6°. An electrophotographic photoreceptor produced by using the titanyl phthalocyanine of the changed crystal structure as a charge generation material has a dark decay ratio (DDR) of 86% and a sensitivity ($E_{1/2}$) of 0.7 lux·sec.

Japanese Patent Application Unexamined Publication No. 2-198452 (1990) discloses that a titanyl phthalocyanine having such a crystal structure as to give a major diffraction peak at a Bragg angle (2θ±0.2°) of 27.3° is produced by heating a titanyl phthalocyanine in a mixture of water and o-dichlorobenzene at 60° C. for 1 hour with stirring and has a high sensitivity (1.7 mJ/m$^2$).

Japanese Patent Application Unexamined Publication No. 2-256059 (1990) discloses that a titanyl phthalocyanine of such a crystal structure as to give a major diffraction peak at a Bragg angle (2θ±0.2°) of 27.3° is produced by stirring a titanyl phthalocyanine in 1,2-dichloroethane at room temperature and has a high sensitivity (0.62 lux·sec).

Japanese Patent Application Unexamined Publication No. 62-194257 (1987) proposes to use mixtures of two or more kinds of phthalocyanines, such as a mixture of titanyl phthalocyanine and a metal-free phthalocyanine, as charge generation materials.

In Japanese Patent Application Unexamined Publication No. 6-175382 (1994) is proposed to produce a novel phthalocyanine composition which has a CuKα-X-ray diffraction spectrum indicating major peaks at Bragg angles (2θ±0.2°) of 7.5°, 22.5°, 24.3°, 25.3° and 28.6°, by precipitating a phthalocyanine mixture containing a titanyl phthalocyanine and a halogenometal phthalocyanine having a trivalent central metal in water using an acid-pasting method, and then treating the precipitate with an organic solvent.

In Japanese Patent Application Unexamined Publication No. 8-41373 (1996) is proposed to produce a novel phthalocyanine composition which has a CuKα-X-ray diffraction spectrum indicating major peaks at Bragg angles (2θ±0.2°) of 9.3°, 13.1°, 15.0° and 26.2°, by precipitating a phthalocyanine mixture containing a titanyl phthalocyanine and a halogenometal phthalocyanine having a trivalent central metal in water using an acid-pasting method, and then treating the precipitate with an organic solvent.

These phthalocyanine compositions transformed in crystal structures are useful as charge generation materials of good properties, but are not satisfactory for recent electrophotography, typically in laser beam printers, which is advanced in image quality and resolution and in requirement for electrophotographic photoreceptors having higher sensitivity, lower residual potential and better image quality.

In Japanese Patent Application Unexamined Publication No. 6-271786 (1994) is proposed a phthalocyanine composition and a method of production thereof, which has a CuKα-X-ray diffraction spectrum indicating major peaks at Bragg angles (2θ±0.2°) of 7.5°, 24.2° and 27.3° and are more sensitive.

As described above, phthalocyanines largely differ in electrophotographic properties depending on their crystal structures, which are therefore important factors influencing the performance of electrophotographic photoreceptors. Particularly, phthalocyanine compositions provide charge generation materials which exhibit excellent properties because of their extremely high sensitivity.

However, electrophotography, typically in laser beam printers, is advanced in image quality and resolution, requiring electrophotographic photoreceptors having higher sensitivity, lower residual potential and better image quality.

It is also known that dark decay ratio, sensitivity and residual potential remarkably change depending on the combinations of charge generation materials and charge transport materials, and investigation into desirable combinations of these materials is required to obtain electrophotographic photoreceptors well-balanced in these properties.

SUMMARY OF THE INVENTION

An object of the present invention is to provide electrophotographic photoreceptors having high sensitivity and low residual potential.

Another object of the present invention is to provide electrophotographic photoreceptors having higher sensitivity, lower residual potential and good image quality.

Another object of the present invention is to provide electrophotographic photoreceptors having higher sensitivity, lower residual potential, high dark decay ratio and good image quality.

Another object of the present invention is to provide electrophotographic photoreceptors which have high and widely controllable sensitivity, low residual potential and excellent image quality.

Another object of the present invention is to provide coating solutions for production of charge transport layers (hereinafter, may be referred to as "charge transport layer coating solutions") whereby electrophotographic photoreceptors with high sensitivity and low residual potential can be produced.

That is, the present invention provides an electrophotographic photoreceptor comprising a conductive support and a photosensitive layer which comprises a charge generation layer containing a charge generation material and a charge transport layer containing a charge transport material, the charge generation material comprising a phthalocyanine composition (A) which comprises a phthalocyanine, and the charge transport material comprising a benzidine derivative (B) represented by the following general formula (I)

(I)

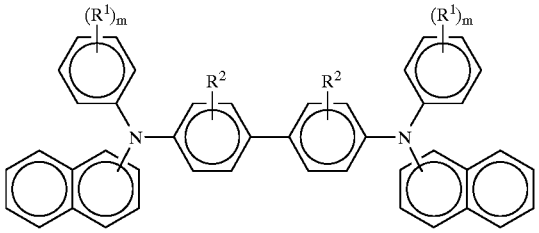

wherein each $R^1$ independently is a halogen atom, an alkyl group, an alkoxy group, an aryl group, a fluoroalkyl group or a fluoroalkoxy group, each $R^2$ independently is hydrogen atom or an alkyl group, m is an integer of 0 to 5, and when the benzidine derivative (B) has two or more R' groups, the groups $R^1$ are identical with or different from each other.

The electrophotographic photoreceptors of the present invention have high sensitivity and low residual potential.

In an embodiment of the electrophotographic photoreceptors of the present invention, the phthalocyanine composition (A) comprises a phthalocyanine composition (III) which has a CuKα-X-ray diffraction spectrum indicating major peaks at Bragg angles (2θ±0.2°) of 7.5°, 24.2° and 27.3°. Electrophotographic photoreceptors of this embodiment have higher sensitivity, lower residual potential and good image quality.

In another embodiment of the electrophotographic photoreceptors of the present invention, the phthalocyanine composition (A) comprises a phthalocyanine composition (IV) which has a CuKα-X-ray diffraction spectrum indicating major peaks at Bragg angles (2θ±0.2°) of 17.9°, 24.0°, 26.2° and 27.2°. Electrophotographic photoreceptors of this embodiment have higher sensitivity, lower residual potential, high dark decay ratio and good image quality.

In another embodiment of the electrophotographic photoreceptor of the present invention, the phthalocyanine composition (A) comprises a phthalocyanine composition (I) which has a CuKα-X-ray diffraction spectrum indicating major peaks at Bragg angles (2θ±0.2°) of 7.5°, 22.5°, 24.3°, 25.3° and 28.6° and the phthalocyanine composition (IV) which has a CuKα-X-ray diffraction spectrum indicating major peaks at Bragg angles (2θ±0.2°) of 17.9°, 24.0°, 26.2° and 27.2°. Electrophotographic photoreceptors of this embodiment have high and widely controllable sensitivity, low residual potential and excellent image quality.

The present invention further provides a coating solution for producing a charge transport layer, containing the benzidine derivative (B) represented by the above general formula (I). The coating solution of the present invention is suited to the production of charge transport layers of electrophotographic photoreceptors having high sensitivity and low residual potential.

PREFERRED EMBODIMENTS OF THE INVENTION

Figure 1:
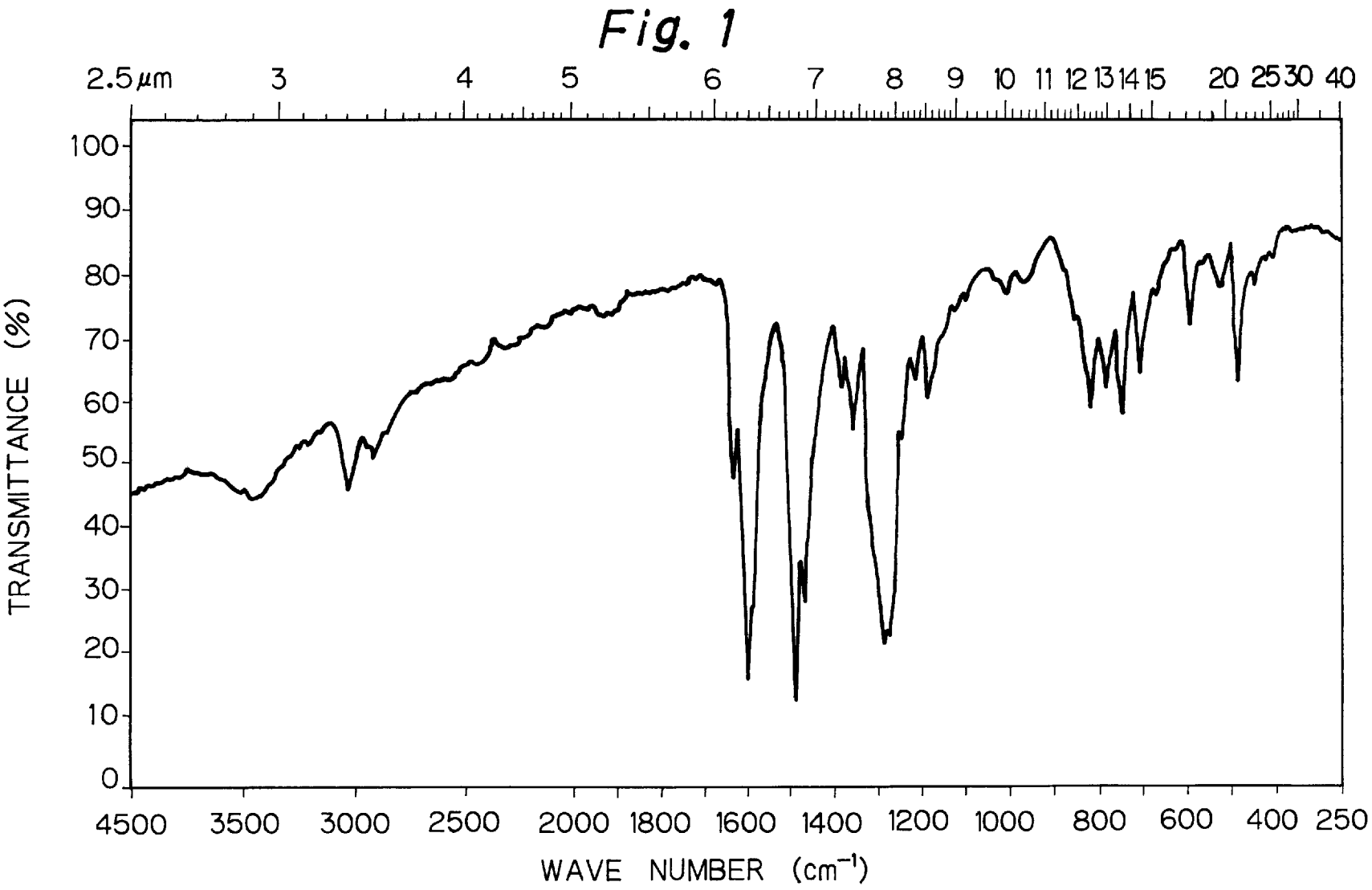
FIG. 1 shows an infrared absorption spectrum of the (B) benzidine derivative (an exemplified compound No. 3).

The electrophotographic photoreceptors of the present invention comprises a conductive support and a photosensitive layer on the conductive support, and the charge generation layer contains a charge generation material which comprises a phthalocyanine composition (A) comprising a phthalocyanine, and the charge transport layer contains a charge transport material which comprises a benzidine derivative (B) represented by the following general formula (I)

(I)

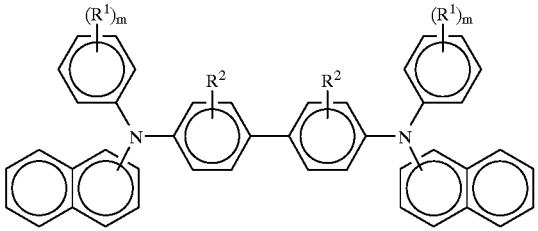

wherein each $R^1$ independently is a halogen atom, an alkyl group, an alkoxy group, an aryl group, a fluoroalkyl group or a fluoroalkoxy group, each $R^2$ independently is hydrogen atom or an alkyl group, m is an integer of 0 to 5, and when the benzidine derivative (B) has two or more R' groups, the groups $R^1$ are identical with or different from each other.

Examples of conductive supports which may be used in the present invention are metal plates (such as aluminum, aluminum alloys, steel, iron or copper), metal compound plates (such as tin oxide, indium oxide or chromium oxide), supports comprising a non-conductive plate bearing a conductive layer, for example, a plastic plate coated with conductive particles (such as carbon black or silver particles) fixed by a binder, and a plastic, paper or glass plate which is coated with such conductive particles by deposition or spattering.

These supports may have, for example, a cylindrical or sheet-like form, but are not particularly limited in form, size and surface roughness.

The charge generation material used in the present invention comprises a phthalocyanine composition (A) comprising a phthalocyanine.

For example, the phthalocyanine composition (A) comprising a phthalocyanine is obtainable by precipitating a phthalocyanine mixture containing (a) a titanyl phthalocyanine and (b) a halogenometal phthalocyanine containing a trivalent central metal in water by an acid-pasting method, to obtain a precipitate having a CuKα-X-ray diffraction spectrum indicating a characteristic peak at a Bragg angle (2θ±0.2°) of 27.2°, which is then treated in an organic solvent or a solvent mixture of an aromatic organic solvent and water.

In general, phthalocyanine mixtures are merely physical mixtures of particles or crystals of two or more kinds of phthalocyanines used as raw materials, and have X-ray diffraction patterns which are overlapping of respective peak patterns of the starting phthalocyanines.

On the other hand, the phthalocyanine composition (A), which comprises a phthalocyanine and is used in the present invention, is a mixture of the molecules of starting phthalocyanines, and its X-ray diffraction pattern differs from the overlapping of respective peak patterns of the starting phthalocyanines.

Titanyl phthalocyanine (a) which may be used in the present invention is not limitative and may be known one. For example, those prepared as follows may be used.

After 18.4 g (0.144 moles) of phthalonitrile is added to 120 ml of α-chloronaphthalene, 4 ml (0.0364 moles) of titanium tetrachloride is added dropwise thereto, and the mixture is then heated to 200 to 220° C. and allowed to react for 3 hours, with stirring. The reaction product is then filtered at 100 to 130° C., followed by washing with successive α-chloronaphthalene and methanol.

Thereafter, hydrolysis with 140 ml of ion-exchanged water (at 90° C. for 1 hour) is repeated until the liquid phase is neutralized. After washed with methanol, the solid product is washed sufficiently with N-methylpyrrolidone heated to 100° C., and then with methanol.

The thus obtained compound is dried in vacuo at 60° C., to obtain a titanyl phthalocyanine (Yield: 46%).

With regards to the halogenometal phthalocyanines (b) containing a trivalent central metal, examples of the trivalent central metal are In, Ga and Al, and examples of the halogen are Cl and Br. The phthalocyanine rings thereof may have substituents, such as halogens.

Such compounds are known, and, for example, in Inorganic Chemistry, 19, 3131 (1980) and Japanese Patent Application Unexamined Publication No. 59-44054 (1984) are disclosed preparation processes of monohalogenometal phthalocyanines and monohalogenometal halogenophthalocyanines.

For example, monohalogenometal phthalocyanines can be prepared as follows.

78.2 mmoles of phthalonitrile and 15.8 mmoles of a trihalogenometal are added to 100 ml of quinoline purified by distillation twice. The mixture is heated under reflux for 0.5 to 3 hours and cooled to room temperature, and the reaction product is filtered. The solid product is washed with successive, toluene, acetone and methanol, and then with methanol by using a Soxhlet's extractor. The washed product is dried in vacuo at 60° C., to obtain a monohalogenometal phthalocyanine.

Monohalogenometal halogenophthalocyanines can be prepared, for example, as follows.

156 mmoles of phthalonitrile and 37.5 mmoles of a trihalogenometal are mixed and molten at 300° C. Heating is further continued for 0.5 to 3 hours, to obtain a crude monohalogenometal halogenophthalocyanine, which is then washed with α-chloronaphthalene by using a Soxhlet's extractor, to give a purified monohalogenometal halogenophthalocyanine.

From the viewpoint of improvements in electrophotographic properties, such as charging efficiency, dark decay ratio and sensitivity, the phthalocyanine mixture which contains a titanyl phthalocyanine (a) and a halogenometal phthalocyanine (b) containing a trivalent central metal contains preferably 20 to 95 parts by weight, more preferably 50 to 90 parts by weight, particularly preferably 65 to 90 parts by weight, extremely preferably 75 to 90 parts by weight of the titanyl phthalocyanine (a), per 100 parts by weight of the total of the components (a) and (b).

The phthalocyanine mixture containing the components (a) and (b) is allowed to precipitate in water by an acid-pasting method to become amorphous.

For example, 1 g of a phthalocyanine mixture is dissolved in 50 ml of concentrated sulfuric acid, and after stirred at room temperature, the solution is added dropwise to 1 liter of ion-exchanged water cooled with ice water, over a period of about 1 hour, preferably 40 to 50 minutes, and the resulting precipitate is collected by filtration.

Subsequently, the precipitate is washed repeatedly with ion-exchanged water until a washing waste water of preferably pH 2 to 5, more preferably pH 3, and having a conductivity of 5 to 500 μS/cm is obtained, and then with methanol sufficiently, and is then dried in vacuo at 60° C., to give a powdery product.

The thus obtained powder of the precipitate prepared from the components (a) and (b) has a CuKα-X-ray diffraction spectrum which indicates only one clear diffraction peak at a Bragg angle (2θ±0.2°) of 27.2°, with other peaks being so wide that their Bragg angles cannot be identified.

If the pH of the washing waste water is higher than 5, the resulting powdery product will have a CuKα-X-ray diffraction spectrum wherein the intensity of the characteristic peak at a Bragg angle (2θ±0.2°) of 27.2° is weakened, and a new peak stronger than the peak at 27.2° appears at 6.8°. Such a powdery product tends to fail to be transformed into the phthalocyanine composition to be used in the present invention even by a crystal structure transformation using a solvent mixture of an aromatic organic solvent and water. If the pH of the washing waste water is lower than 2 or higher than 5, charging efficiency, dark decay ratio and sensitivity may be lowered.

If the washing waste water has a conductivity of lower than 5 μs/cm or higher than 500 μs/cm, charging efficiency, dark decay ratio and sensitivity may be lowered.

The phthalocyanine composition (A) to be used in the present invention can be prepared by treating the powdery precipitate (amorphous phthalocyanine) in an organic solvent or a solvent mixture of an aromatic organic solvent and water to transform the crystal structure thereof.

Examples of organic solvents which can be used for the transformation of crystal structure in an organic solvent are N-methyl-2-pyrrolidone, methyl ethyl ketone, diethyl ketone, pyridine, tetrahydrofuran, benzene, toluene, xylene and o-dichlorobenzene.

The transformation of crystal structure in an organic solvent can be performed, for example, by adding 100 parts by weight of an organic solvent to 5 to 30 parts by weight of the precipitate (the dried powdery product of the above-described precipitate), and then heating the mixture to 80 to 150° C. for 2 to 6 hours.

Examples of organic solvents usable for the transformation of crystal structures in a solvent mixture of an aromatic organic solvent and water are benzene, toluene, xylene and o-dichlorobenzene. The ratio of the aromatic organic solvent to water, aromatic organic solvent/water, is preferably 1/99 to 99/1 (weight ratio), more preferably 95/5 to 5/95.

The transformation of crystal structures in a solvent mixture of an aromatic organic solvent and water can be performed, for example, by making 100 parts by weight of the solvent mixture in contact with 1 to 5 parts by weight of the precipitate (the dried powdery product of the above-described precipitate) at 40 to 100° C., preferably 60 to 80° C., for at least 1 hour, preferably 1 to 24 hours.

The contact is preferably performed by carrying out heating and stirring concurrently, or by carrying out grinding, heating and stirring concurrently, to obtain phthalocyanine compositions the use of which as charge generation materials provides electrophotographic photoreceptors having stable electrophotographic properties.

Preferred methods for performing grinding, heating and stirring concurrently are, for example, a heating-milling treatment, homogenizing and paint shaking, and a particularly preferred method is a heating-milling treatment because it affords particularly stable electrophotographic properties.

Preferred media for the milling of the heating-milling treatment are beads of materials having a specific gravity of 3 or more, such as zirconia beads and alumina beads, and the beads preferably have a diameter of ϕ0.2 to 3 mm, more preferably ϕ0.5 to 2 mm, particularly preferably ϕ0.8 to 1.5 mm.

Among the phthalocyanine compositions (A) obtainable by the above methods, preferred compositions are phthalocyanine compositions which are obtainable by performing the contact by carrying out heating and stirring concurrently, such as a phthalocyanine composition (I) having a CuKα-X-ray diffraction spectrum indicating major peaks at Bragg angles (2θ±0.2°) of 7.5°, 22.5°, 24.3°, 25.3° and 28.6°, a phthalocyanine composition (III) having a CuKα-X-ray diffraction spectrum indicating major peaks at Bragg angles (2θ±0.2°) of 7.5°, 24.2° and 27.3° and a phthalocyanine composition (II) having a CuKα-X-ray diffraction spectrum indicating major peaks at Bragg angles (2θ±0.2°) of 9.3°, 13.1°, 15.0° and 26.2°, particularly the phthalocyanine compositions (III) and (I), a more preferred composition is a phthalocyanine composition (IV) which is obtainable by performing the contact by carrying out grinding, heating and stirring concurrently and has a CuKα-X-ray diffraction spectrum indicating major peaks at Bragg angles (2θ±0.2°) of 17.9°, 24.0°, 26.2° and 27.2°.

These phthalocyanine compositions (A) may be used individually or as a mixture of two or more. A preferred example of such a mixture is a mixture of the phthalocyanine composition (I) which has a CuKα-X-ray diffraction spectrum indicating major peaks at Bragg angles (2θ±0.2°) of 7.5°, 22.5°, 24.3°, 25.3° and 28.6° and the phthalocyanine composition (IV) which has a CuKα-X-ray diffraction spectrum indicating major peaks at Bragg angles (2θ±0.2°) of 17.9°, 24.0°, 26.2° and 27.2°. This mixture preferably contains the phthalocyanine composition (I) which has a CuKα-X-ray diffraction spectrum indicating major peaks at Bragg angles (2θ±0.2°) of 7.5°, 22.5°, 24.3°, 25.3° and 28.6° and the phthalocyanine composition (IV) which has a CuKα-X-ray diffraction spectrum indicating major peaks at Bragg angles (2θ±0.2°) of 17.9°, 24.0°, 26.2° and 27.2° in a weight ratio of 1/99 to 99/1, more preferably 10/90 to 90/10.

In addition to the phthalocyanine compositions (A), the charge generation material to be used in the present invention may optionally contain other charge generation materials than the phthalocyanine compositions (A) according to demands, in such amounts as not to deteriorate the electrophotographic properties of the electrophotographic photoreceptors of the present invention.

Examples of the optionally usable charge generation materials other than the phthalocyanine compositions (A)

are organic pigments known to generate charge, such as azoxybenzene pigments, disazo pigments, trisazo pigments, benzimidazole pigments, polycyclic quinone pigments, indigoid pigments, quinacridone pigments, perylene pigments, methine pigments, metal-free and metallo-phthalocyanine pigments of various crystal structures, such as α, β, γ, δ, ε and χ-structures.

These pigments are disclosed, for example, in Japanese Patent Application Unexamined Publication Nos. 47-37543 (1972), 47-37544 (1972), 47-18543 (1972), 47-18544 (1972), 48-43942 (1973), 48-70538 (;973), 49-1231 (1974), 49-105536 (1974), 50-75214 (1975), 53-44028 (1988) and 54-17732 (1989).

τ-, τ'-, η- and η'-metal-free phthalocyanines, which are disclosed in Japanese Patent Application Unexamined Publication No. 58-182640 (1983) and European Patent Application Publication No. 92,255, may also be used. Other any organic pigment which generates charge carriers by light irradiation may also be used.

The total amount of the charge generation materials other than the phthalocyanine compositions (A) is preferably 100 parts by weight or less per 100 parts by weight of the phthalocyanine compositions (A). If the amount is more than 100 parts by weight, the electrophotographic properties of the electrophotographic photoreceptors of the present invention may be deteriorated.

The charge generation material comprising the phthalocyanine compositions (A) and other optional charge generation materials may be dispersed or dissolved uniformly in a solvent to prepare a coating solution for production of charge generation layers (hereinafter, may be referred to as "charge generation layer coating solution").

The charge generation layer coating solution preferably contains a binder.

Any resin which is an insulator and can form coating under ordinary conditions or by curing (crosslinking) with heat and/or light (namely, thermosetting resins and photosetting resins) can be used as the binder without particular limitation, and examples of usable resins are silicone resins, polyamide resins, polyurethane resins, polyester resins, epoxy resins, polyketone resins, polycarbonate resins, polycarbonate copolymers, polyestercarbonate resins, polyformal resins, poly(2,6-dimethylphenyleneoxide), polyvinylbutyral resins, polyvinylacetal resins, styrene-acrylic copolymers, polyacrylic resins, polystyrene resins, melamine resins, styrene-butadiene copolymers, polymethylmethacrylate resins, polyvinylchloride, ethylene-vinyl acetate copolymers, vinyl chloride-vinyl acetate copolymers, polyacrylamide resins, polyvinylcarbazole, polyvinylpyrazoline and polyvinylpyrene. These binders may be used individually or as a mixture of two or more.

The total amount of binders is preferably 0 to 500 parts by weight, more preferably 30 to 500 parts by weight per 100 parts by weight of the total of the phthalocyanine compositions (A) and other optional charge generation materials.

In the cases where binders are added in the charge generation layer coating solution, additives, such as plasticizers, fluidizing agents, anti-pin-hole agents, antioxidants and UV absorbers, may also be added, according to demands.

Examples of usable plasticizers are biphenyl, 3,3',4,4'-tetramethyl-1,1'-biphenyl, 3,3",4,4"-tetramethyl-p-terphenyl, 3,3",4,4"-tetramethyl-m-terphenyl, paraffin halides, dimethylnaphthalene and dibutyl phthalate.

Examples of usable fluidizing agents are Modaflow (Trade name, produced by Monsanto Chemical Co., Ltd.) and Acronal 4F (Trade name, produced by BASF Aktiengeselschaft).

Examples of usable anti-pin-hole agents are benzoin and dimethyl phthalate.

Examples of usable antioxidants and examples of usable UV absorbers are 2,6-di-t-butyl-4-methylphenol, 2,4-bis(n-octylthio)-6-(4-hydroxy-3,5-di-t-butylanilino)-1,3,5-triazine, 1,3,5-trimethyl-2,4,6-tris(3,5-di-t-butyl-4-hydroxybenzyl)benzene, 2-(5-t-butyl-2-hydroxyphenyl) benzotriazole, 2-[2-hydroxy-3,5-bis(α,α-dimethylbenzyl) phenyl]-2H-benzotriazole and Antigen FR (Trade name, produced by Ohuchi Shinkoh Kagaku Kabushiki Kaisha).

These additives may be used selectively, respectively, and the total amount thereof is preferably 5 parts by weight based on 100 parts by weight of the total of the phthalocyanine compositions (A) and other optional charge generation materials.

As to the solvents used in the charge generation layer, it is preferable to use solvents which do not dissolve the phthalocyanine compositions (A).

Examples of such solvents usable in the charge generation layer coating solution are aromatic solvents (such as toluene, xylene and anisole), ketone solvents (such as cyclohexanone and methylcyclohexanone), hydrocarbon halide solvents (such as methylene chloride and tetrachlorocarbon)., alcohol solvents (such as methanol, ethanol, propanol, 1-butanol, isobutanol, 1-methoxy-2-propanol, 2-methoxyethanol, 2-ethoxyethanol and 2-butoxyethanol) and ether solvents (such as tetrahydrofuran, 1,3-dioxolane and 1,4-dioxane). These solvents may be used individually or in a combination of two or more.

The amount of solvents in the charge generation layer coating solution is preferably 900 to 10,000 parts by weight, preferably 1,900 to 8,000 parts by weight, per 100 parts by weight of the total of the phthalocyanine compositions (A), other optional charge generation materials, binders and additives. If it is less than 900 parts by weight, it may be difficult to produce charge generation layers of a thickness of not more than 1 μm, which is an upper limit of desirable thickness of charge generation layers, and if more than 10,000 parts by weight, it may be difficult to produce charge generation layers of a thickness of not less than 0.01 μm, which is a lower limit of the thickness of charge generation layers.

Shaking, paint shakers, mechanical stirrers, homogenizers, homomixers or the like may be employed to disperse the phthalocyanine compositions (A), to disperse or dissolve other optional charge generation materials and to dissolve binders and additives in solvents uniformly.

The charge transport material to be used in the present invention contains a benzidine derivative (B) represented by the following general formula (I)

(I)

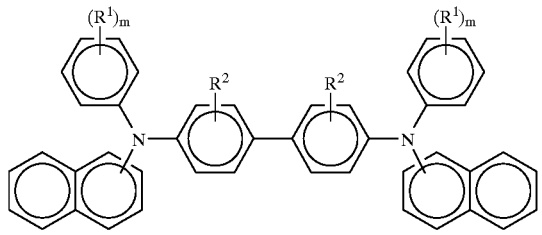

wherein each $R^1$ independently is a halogen atom, an alkyl group, an alkoxy group, an aryl group, a fluoroalkyl group or a fluoroalkoxy group, each $R^2$ independently is hydrogen atom or an alkyl group, m is an integer of 0 to 5, and when the benzidine derivative (B) has two or more R' groups, the groups $R^1$ are identical with or different from each other.

Benzidine derivatives (B) represented by the general formula (I) can be prepared, for example, as follows.

A halogenobiphenyl derivative represented by the following general formula (II)

(II)

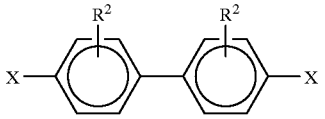

wherein each $R^2$ independently-is a hydrogen atom or an alkyl group and each X independently is iodine or fluorine, and a phenylnaphthylamine compound represented by the following general formula (III)

(III)

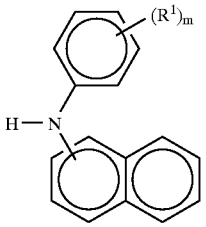

wherein each $R^1$ independently is a halogen atom, an alkyl group, an alkoxy group, an aryl group, a fluoroalkyl group or a fluoroalkoxy group, m is an integer of 0 to 5, and when the benzidine derivative (B) has two or more R' groups, the groups $R^1$ are identical with or different from each other, are heated to 180 to 260° C. for 5 to 30 hours in the presence of a copper catalyst (for example copper powder or a copper compound, such as copper oxide or a copper halide) and a basic compound (for example an alkali metal carbonate or hydroxide, such as potassium carbonate, sodium carbonate, potassium hydroxide or sodium hydroxide), and in the absence of solvents or in the presence of an organic solvent (such as nitrobenzene, dichlorobenzene, quinoline, N,N-dimethylformamide, N-methyl-2-pyrrolidone or sulfolane). The reaction mixture is then dissolved in an organic solvent, such as methylene chloride or toluene. After insoluble matters are separated from the solution and the solvent is distilled off, the residue is purified with an alumina column or the.like and then recrystallized from hexane, cyclohexane or the like, to give a benzidine derivative (B) represented by the general formula (I).

In general, the halogenobiphenyl derivative, the phenylnaphthylamine compound, the copper catalyst and the basic compound are used in stoichiometrical amounts, and, it is preferable to use 2 to 3 moles of the phenylnaphthylamine compound, 0.5 to 2 moles of the copper catalyst and 1 to 2 moles of the basic compound per 1 mole of the halogenobiphenyl compound.

Examples of the groups represented by $R^1$ and $R^2$ in the general formula (I) are as follows. Typical halogen atoms are chlorine atom and fluorine atom. Typical alkyl groups are . alkyl groups of 1 to 6 carbon atoms, such as methyl, ethyl, n-propyl, iso-propyl, n-butyl and tert-butyl. Typical alkoxy groups are alkoxy groups of 1 to 6 carbon atoms, such as methoxy, ethoxy, n-propoxy and iso-propoxy. Typical aryl groups are aryl groups of 6 to 20 carbon atoms, such as phenyl, tolyl, biphenyl, terphenyl and naphthyl. Typical fluoroalkyl groups are fluoroalkyl groups of 1 to 6 carbon atoms, such as trifluoromethyl, trifluoroethyl groups, such as 2,2,2-trifluoroethyl, and heptafluoropropyl. Typical fluoroalkoxy groups are fluoroalkoxy groups of 1 to 6 carbon atoms, such as trifluoromethoxy, 2,2-difluoroethoxy, 2,2,2-trifluoroethoxy, 1H,1H-pentafluoropropoxy, hexafluoro-iso-propoxy groups, such as hexafluoro-iso-propoxy, 1H,1H-heptafluorobutoxy, 2,2,3,4,4,4-hexafluorobutoxy and 4,4,4-trifluorobutoxy.

Typical examples of the benzidine derivatives (B) represented by the general formula (I) are shown below.

No. 1

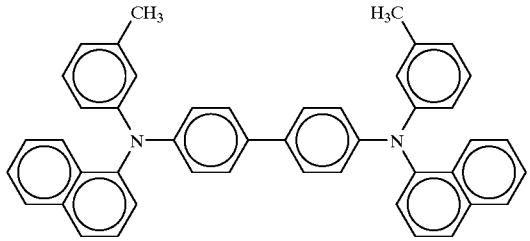

No. 2

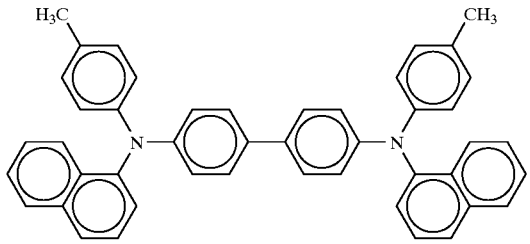

No. 3

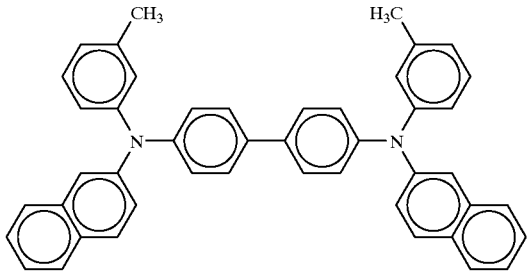

No. 4

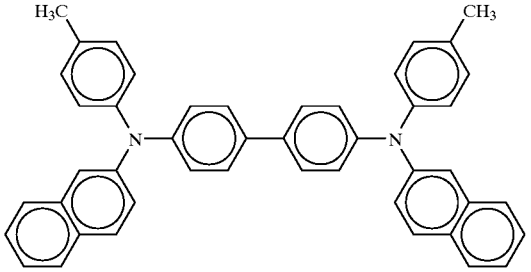

No. 5

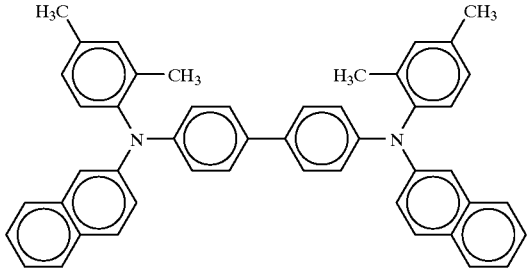

-continued

No. 6

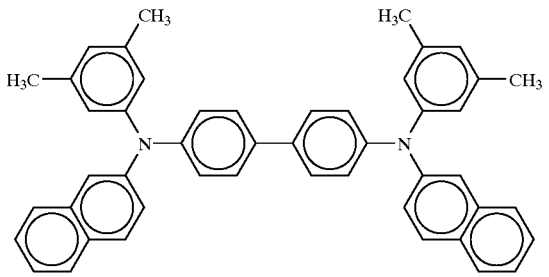

No. 7

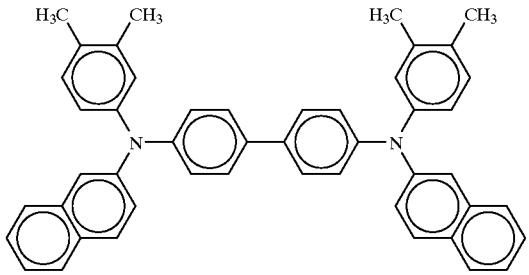

No. 8

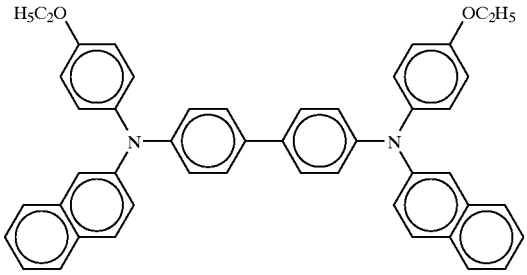

No. 9

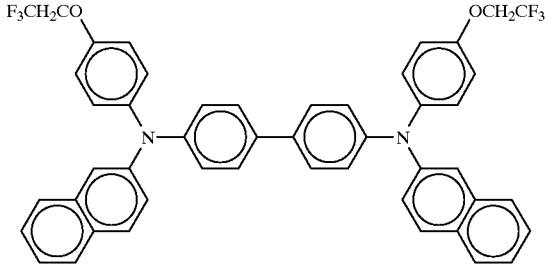

No. 10

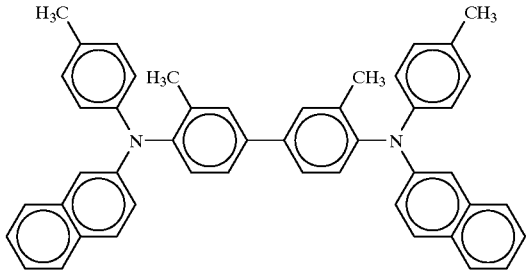

Of these, the compounds No. 3, No. 4 and No. 7 are preferred, with the compound No. 3 particularly preferred.

As to a typical example of the production of the benzidine compounds (B) represented by the general formula (I), the compound No. 3 can be synthesized as follows.

In a 100 ml-round bottom-glass flask equipped with a condenser with a water collector, a thermometer and a stirrer are charged 25.4 g (176 mmoles) of 2-naphthol, 21.1 g (197 mmoles) of m-methylaniline and 2.1 g (11 mmoles) of p-toluenesulfonic acid monohydrate in a stream of nitrogen, and are then heated, sequentially, to 190° C. for 1 hour, to 220° C. for 2 hours, and to 250° C. for 1 hour. After cooled to room temperature, the reaction mixture is dissolved in hot acetone, and the solution is filtered and poured into ice water (acetone/water=1/1 to 1/2 in volume ratio).

Resulting precipitate is filtered off, washed with methanol/water (1/1 volume ratio) and dried, to give 40.8 g (174 mmoles) of a milk white powder of m-methylphenyl-2-naphthylamine.

Subsequently, in a 100 ml-round bottom-glass flask equipped with a condenser with a water collector, a thermometer and a stirrer are charged 10.2 g (25.1 mmoles) of 4,4'-diiodobiphenyl, 17.6 g (75.4 mmoles) of m-methylphenyl-2-naphthylamine, 5.3 g (38.3 mmoles) of potassium carbonate and 2.1 g (33 mmoles) of copper powder in a stream of nitrogen, heated to 210° C. for 20 hours, cooled to room temperature and dissolved in hot toluene. The solution is separated by column chromatography on neutral alumina using a developing solvent mixture of toluene/cyclohexane=1/4 to 1/3 (volume ratio), to give a light-yellow solid.

The light-yellow solid is recrystallized from methylcyclohexane to give 10.5 g (17 mmoles) of white crystals of N,N'-bis(3-methylphenyl)-N,N'-bis(2-naphthyl)-[1,1'-biphenyl]-4,4'-diamine (above-exemplified compound No. 3) (yield=68%). An infrared absorption spectrum of the obtained N,N'-bis(3-methylphenyl)-N,N'-bis(2-naphthyl)-[1,1'-biphenyl]-4,4'-diamine (above-exemplified compound No. 3) (taken with a infrared spectrophotometer, 270-30-type, produced by Hitachi, Ltd.) is shown in FIG. 1.

According to demands, the-charge transport material to be used in the present invention may optionally contain, in addition to the benzidine derivatives (B), other charge transport materials in such amount as not to deteriorate the properties of the electrophotographic photoreceptors of the present invention.

Examples of the optional charge transport materials other than the benzidine derivatives (B) are, as high molecular weight compounds, poly-N-vinylcarbazole, poly-N-vinylcarbazole halides, polyvinylpyrene, polyvinylindoloquinoxaline, polyvinylbenzothiophene, polyvinylanthracene, polyvinylacridine and polyvinylpyrazoline, and as low molecular weight compounds, fluorenone, fluorene, 2,7-dinitro-9-fluorenone, 4H-indeno(1,2,6-thiophene-4-one, 3,7-dinitrodibenzothiophene-5-oxide, 1-bromopyrene, 2-phenylpyrene, carbazole, N-ethylcarbazole, 3-phenylcarbazole, 3-(N-methyl-N-phenylhydrazone) methyl-9-etylcarbazole, 2-phenylindole, 2-phenylnaphthalene, oxadiazole, 2,5-bis(4-diethylaminophenyl)-1,3,4-oxadiazole, 1-phenyl-3-(4-diethylaminostyryl)-5-(4-diethylaminostyryl)-5-(4-diethylaminophenyl)pyrazoline, 1-phenyl-3-(p-diethylaminophenyl)pyrazoline, p-(dimethylamino)stilbene, 2-(4-dipropylaminophenyl)-4-(4-dimethylaminophenyl)-5-(2-chlorophenyl)-1,3-oxazole, 2-(4-dimethylaminophenyl)-4-(4-dimethylaminophenyl)-5-(2-fluorophenyl)-1,3-oxazole, 2-(4-diethylaminophenyl)-4-(4-dimethylaminophenyl)-5-(2-fluorophenyl)-1,3-oxazole, 2-(4-dipropylaminophenyl)-4-(4-dimethylaminophenyl)-5-(2-fluorophenyl)-1,3-oxazole, imidazole, chrysene, tetraphene, acridine, triphenylamine, derivatives of these compounds, 4-N',N'-diphenylaminobenzaldehyde-N,N-diphenylhydazone, 4-N',N'-ditolylaminobenzaldehyde-N,N-diphenylhydrazone, N,N,N',N'-tetraphenylbenzidine, N,N'-diphenyl-N,N'-bis(3-methylphenyl)benzidine, N,N'- diphenyl-N,N'-bis(4-methylphenyl)benzidine, N,N,N',N'-tetrakis(3-methylphenyl)benzidine, N,N,N',N'-tetrakis(4-methylphenyl)benzidine, N,N'-diphenyl-N,N'-bis(4-methoxyphenyl)benzidine, N,N,N',N'-tetrakis(4-methylphenyl)tolidine, 1,1-bis(4-diethylaminophenyl)-4,4-diphenyl-1,3-butadiene and derivatives of these compounds.

In the cases where these optional charge transport materials are used along with the benzidine derivatives (B), the amount thereof is preferably 100 parts by weight or less per 100 parts by weight of the benzidine derivatives (B). If it is more than 100 parts by weight, the properties of the electrophotographic photoreceptors of the present invention may be deteriorated.

The charge transport layer coating solution of the present invention can be prepared by dissolving the charge transport material containing the benzidine derivatives (B) and the optional charge transport materials other than the benzidine derivatives (B) in a solvent uniformly.

The charge transport layer coating solution of the present invention may contain binders.

Any resin which is an insulator and can form coating under ordinary conditions or by curing (crosslinking) with heat and/or light (namely, thermosetting resins and photosetting resins) can be used as a binder without particular limitation, and examples of usable resins are silicone resins, polyamide resins, polyurethane resins, polyester resins, epoxy resins, polyketone resins, polycarbonate resins, polycarbonate copolymers, polyestercarbonate resins, polyformal resins, poly(2,6-dimethylphenyleneoxide), polyvinylbutyral resins, polyvinylacetal resins, styrene-acrylic copolymers, polyacrylic resins, polystyrene resins, melamine resins, styrene-butadiene copolymers, polymethyl methacrylate resins, polyvinylchloride, ethylene-vinyl acetate copolymers, vinyl chloride-vinyl acetate copolymers, polyacrylamide resins, polyvinylcarbazole, polyvinylpyrazoline and polyvinylpyrene. These binders may be used individually or as a mixture of two or more.

The amount of binders is preferably 0 to 500 parts by weight, more preferably 30 to 500 parts by weight, per 100 parts by weight of the total of the benzidine derivatives (B) and the optional charge transport materials other-than the benzidine derivatives (B).

In the cases where the optional charge transport materials other than the benzidine derivatives (B) are low molecular weight compounds, the amount of binders is preferably 50 to 500 parts by weight per 100 parts by weight of the total of the benzidine derivatives (B) and the optional charge transport materials other than the benzidine derivatives (B).

The charge transport layer coating solution of the present invention may contain additives, such as plasticizers, fluidizing agents, anti-pin-hole agents, antioxidants and UV absorbers, according to demands.

Examples of usable plasticizers are biphenyl, 3,3',4,4'-tetramethyl-1,1'-biphenyl, 3,3",4,4"-tetramethyl-p-terphenyl, 3,3",4,4"-tetramethyl-m-terphenyl, paraffin halides, dimethylnaphthalene and dibutyl phthalate.

Examples of usable fluidizing agents are Modaflow (Trade name, produced by Monsanto Chemical Co., Ltd.) and Acronal 4F (Trade name, produced by BASF Aktiengeselschaft).

Examples of usable anti-pin-hole agents are benzoin and dimethyl phthalate.

Examples of usable antioxidants and examples of usable UV absorbers are 2,6-di-t-butyl-4-methylphenol, 2,4-bis(n-octylthio)-6-(4-hydroxy-3,5-di-t-butylanilino)-1,3,5-triazine, 1,3,5-trimethyl-2,4,6-tris(3,5-di-t-butyl-4-hydroxybenzyl)benzene, 2-(5-t-butyl-2-hydroxyphenyl) benzotriazole, 2-[2-hydroxy-3,5-bis(α,α-dimethylbenzyl) phenyl]-2H-benzotriazole and Antigen FR (Trade name, produced by Ohuchi Shinkoh Kagaku Kabushiki Kaisha).

These additives may optionally be used respectively, and the total amount thereof is preferably 5 parts by weight or less per 100 parts by weight of the total of the benzidine derivatives (B) and other optional charge transport materials.

Examples of solvents which can be used in the charge transport layer coating solution are aromatic solvents (such as toluene, xylene and anisole), ketone solvents (such cyclohexanone and methylcyclohexanone), hydrocarbon halide solvents (such as methylene chloride and tetrachlorocarbon), and ether solvents (such as tetrahydrofuran, 1,3-dioxolane and 1,4-dioxane). These solvents may be used individually or in a combination of two or more.

The amount of solvents in the charge transport layer coating solution is preferably 250 to 1,000 parts by weight, preferably 250 to 700 parts by weight, per 100 parts by weight of the total of the benzidine derivatives (B), other optional charge transport materials, binders and additives. If it is less than 250 parts by weight, it may be difficult to produce charge transport layers of a thickness of not more than 50 μm, which is an upper limit of desirable thickness of charge transport layers, and if more than 1,000 parts by weight, it may be difficult to produce charge transport layers of a thickness of not less than 5 μm, which is a lower limit of the thickness of charge transport layers.

Shaking, paint shakers, mechanical stirrers, homogenizers, homomixers or the like may be employed to dissolve charge transport materials in solvents uniformly.

The electrophotographic photoreceptors of the present invention has, on the above-described conductive support, a charge generation layer which contains the charge generation material comprising the above phthalocyanine composition (A) and a charge transport layer which contains the charge transport material comprising the benzidine derivative (B). The combination of the charge generation layer which contains the charge generation material comprising the above phthalocyanine composition (A) and the charge transport layer which contains the charge transport material comprising the above benzidine derivative (B) contributes good properties, such as high sensitivity and low residual potential, to the electrophotographic photoreceptors of the present invention.

For example, the charge generation layer and the charge transport layer can be formed on the conductive support by applying the above charge generation layer coating solution and the charge transport layer coating solution of the present invention to the conductive support respectively, followed by drying.

The application of the charge generation layer coating solution and the charge transport layer coating solution of the present invention to the conductive support can be performed, for example, by spin coating or dipping.

By a spin coating method, the charge generation layer coating solution and the charge transport layer coating solution of the present invention are applied, respectively, at a spin coating rotational speed of 500 to 4,000 rpm, and by a dipping technique, the conductive support is dipped in the charge generation layer coating solution and in the charge transport layer coating solution of the present invention.

The drying following to application is performed generally at 80 to 140° C. for 5 to 90 minutes.

The charge generation layer in the electrophotographic photoreceptors of the present invention is preferably 0.01 to 1 μm thick, more preferably 0.1 to 0.5 μm thick. If it is less than 0.01 μm thick, it may be difficult to make uniform, and if more than 1 μm thick, it may deteriorate electrophotographic properties.

The charge transport layer in the electrophotographic photoreceptor of the present invention is preferably 5 to 50 μm thick, more preferably 15 to 30 μm thick. If it is less than 5 μm thick, initial potential may be decreased, and if more than 50 μm thick, sensitivity may be lowered.

In the electrophotographic photoreceptor of the present invention, either of the charge generation layer and the charge transport layer can be superposed on the other, and as well, two charge transport layers can be formed to interpose one charge generation layer therebetween.

The electrophotographic photoreceptor of the present invention may have other layers, such as a thin adhesive layer or a barrier layer, directly on the conductive support and, also, a protection layer on its surface.

Hereinafter, the present invention will be described in detail referring to examples.

EXAMPLES 1 TO 14 AND COMPARATIVE EXAMPLES 1 TO 9

Preparation Example 1

(Preparation of (A) phthalocyanine composition (I))

<Step-1>

48 g of a phthalocyanine mixture comprising 36 g of titanyl phthalocyanine and 12 g of chloroindium phthalocyanine is dissolved in 2.4 l of concentrated sulfuric acid, stirred for 30 minutes at room temperature, and then reprecipitated by adding it dropwise to 48 l of ion-exchanged water cooled with ice water over a 50-minute period. After stirring was continued for 30 minutes with cooling, the precipitate was collected by filtration.

<Step-2>

The first washing was carried out by adding 4 l of ion-exchanged water to the precipitate, stirring the mixture and then filtering off the precipitate. The same washing procedure was repeated four times, and after the fifth washing, the pH and conductivity of the filtrate (namely the washing water resulting from the fifth washing) were measured (23° C.)

The washing water was pH 3.4 and had a conductivity of 65.0 $\mu$S/cm. The pH was obtained by measurement with a Model PH51 produced by Yokokawa Denki Co., Ltd., and the conductivity with a Model SC-17A produced by Shibata Kagaku Kikai Kogyo Co., Ltd.

<Step-3>

After further washed three times with 4 l of methanol, the precipitate was heated in vacuo to 60° C. for 4 hours, to obtain a dried precipitate (X).

Figure 2:
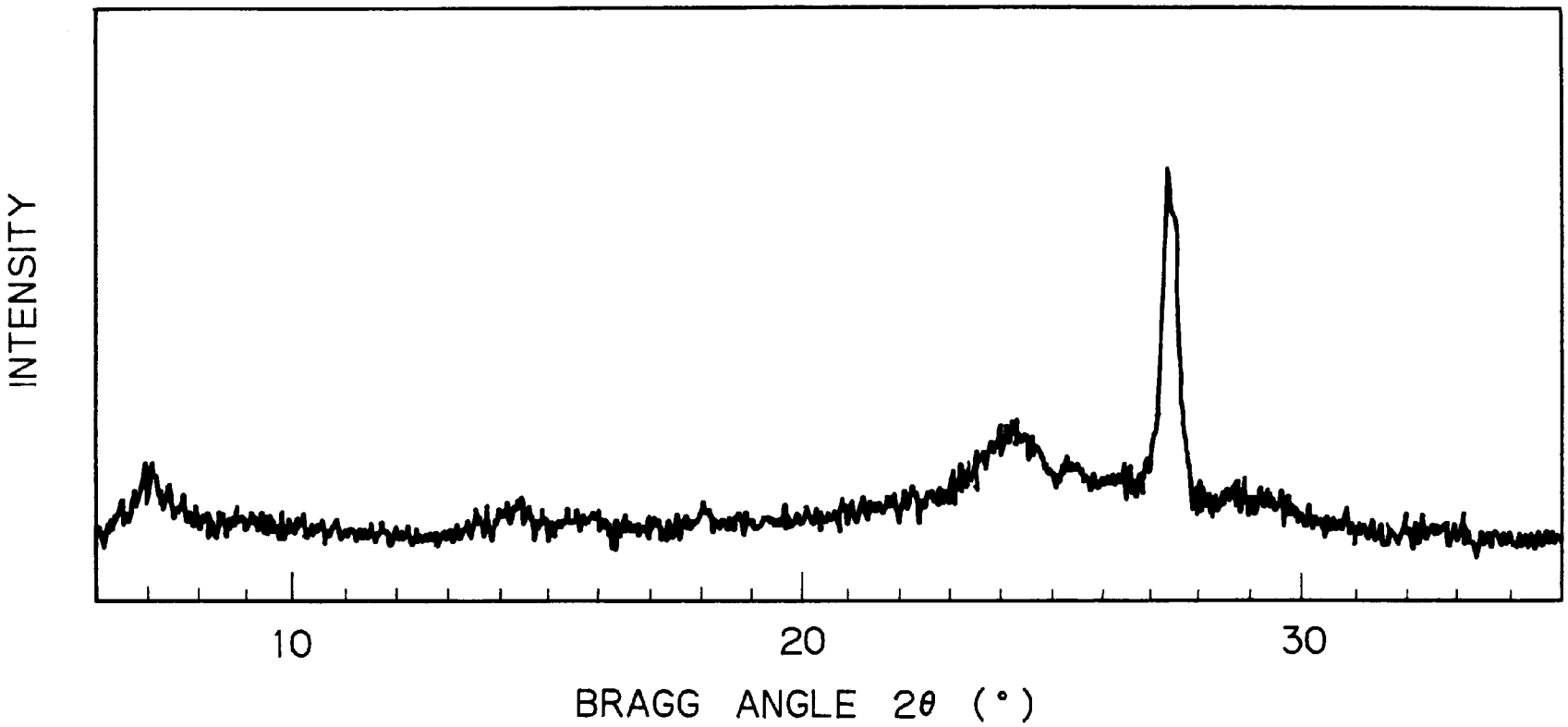
FIG. 2 shows an X-ray diffraction spectrum of the dried precipitate prepared in Preparation Example 1.

An X-ray diffraction spectrum of the dried precipitate (X) indicated a clear peak at a Bragg angle (2θ±0.2°) of 27.2°. FIG. 2 shows the X-ray diffraction spectrum.

The X-ray diffraction spectrum was measured with a RAD-IIIA produced by Rigaku-Denki Co., Ltd.

<Step-4>

Figure 3:
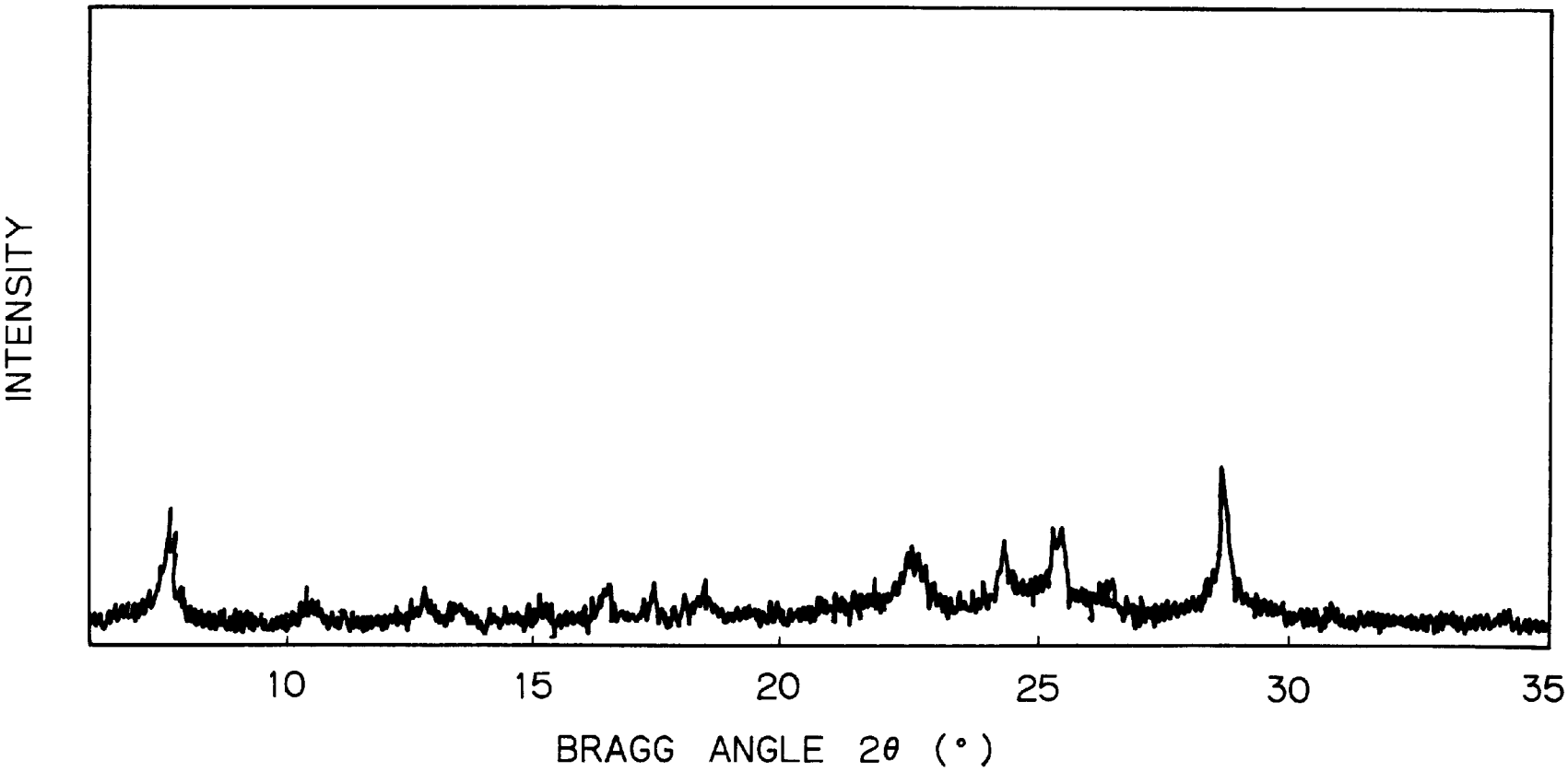
FIG. 3 shows an X-ray diffraction spectrum of the (A) phthalocyanine composition (I) prepared in Preparation Example 1.

100 ml of 1-methyl-2-pyrrolidone was added to 10 g of the dried precipitate (X), and the mixture was heated to 150° C. for 1 hour with stirring. After cooling and filtering, the solids were washed with methanol sufficiently, and then heated in vacuo to 60° C. for 4 hours to dry, to obtain crystals of a (A) phthalocyanine composition (I). An X-ray diffraction spectrum of the (A) phthalocyanine composition (I) indicated major peaks at Bragg angles (2θ±0.2°) of 7.5°, 22.5°, 24.3°, 25.3° and 28.6°. FIG. 3 shows the X-ray diffraction spectrum.

Preparation Example 2

(Preparation of (A) phthalocyanine composition (II))

A dried precipitate (Y) was prepared by repeating the procedures of Steps-1 to 3 of Preparation Example 1 except that, in Step-1, 60 g of a phthalocyanine mixture comprising 45 g of titanyl phthalocyanine and 15 g of chloroindium phthalocyanine was dissolved in 1.2 l of concentrated sulfuric acid.

Figure 4:
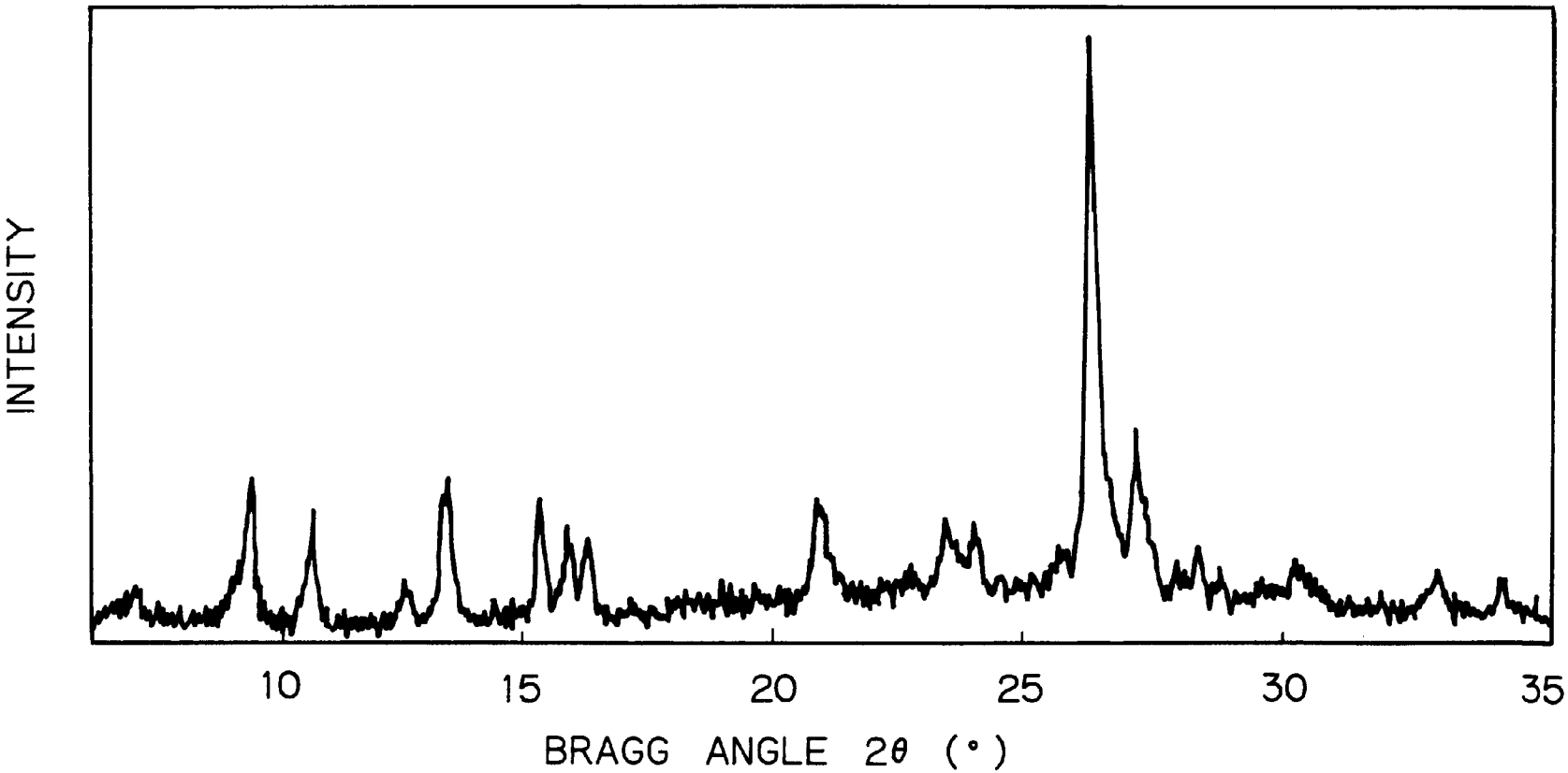
FIG. 4 shows an X-ray diffraction spectrum of the (A) phthalocyanine composition (II) prepared in Preparation Example 2.

100 ml of 1-methyl-2-pyrrolidone was added to 10 g of the dried precipitate (Y), and the mixture was heated to 150° C. for 1 hour with stirring. After cooling and filtering, the solids were washed with methanol sufficiently, and then heated in vacuo to 60° C. for 4 hours to dry, to obtain crystals of a (A) phthalocyanine composition (II). An X-ray diffraction spectrum of the (A) phthalocyanine composition (II) indicated major peaks at Bragg angles (2θ±0.2°) of 9.3°, 13.1°, 15.0° and 26.2°. FIG. 4 shows the X-ray diffraction spectrum.

Preparation Example 3

(Preparation of (A) phthalocyanine composition (III))

A dried precipitate (X) was prepared by repeating the procedures of Steps-1 to 3 of Preparation Example 1. An X-ray diffraction spectrum of the dried precipitate (X) indicated a clear peak at a Bragg angle (2θ±0.2°) of 27.2°.

Figure 5:
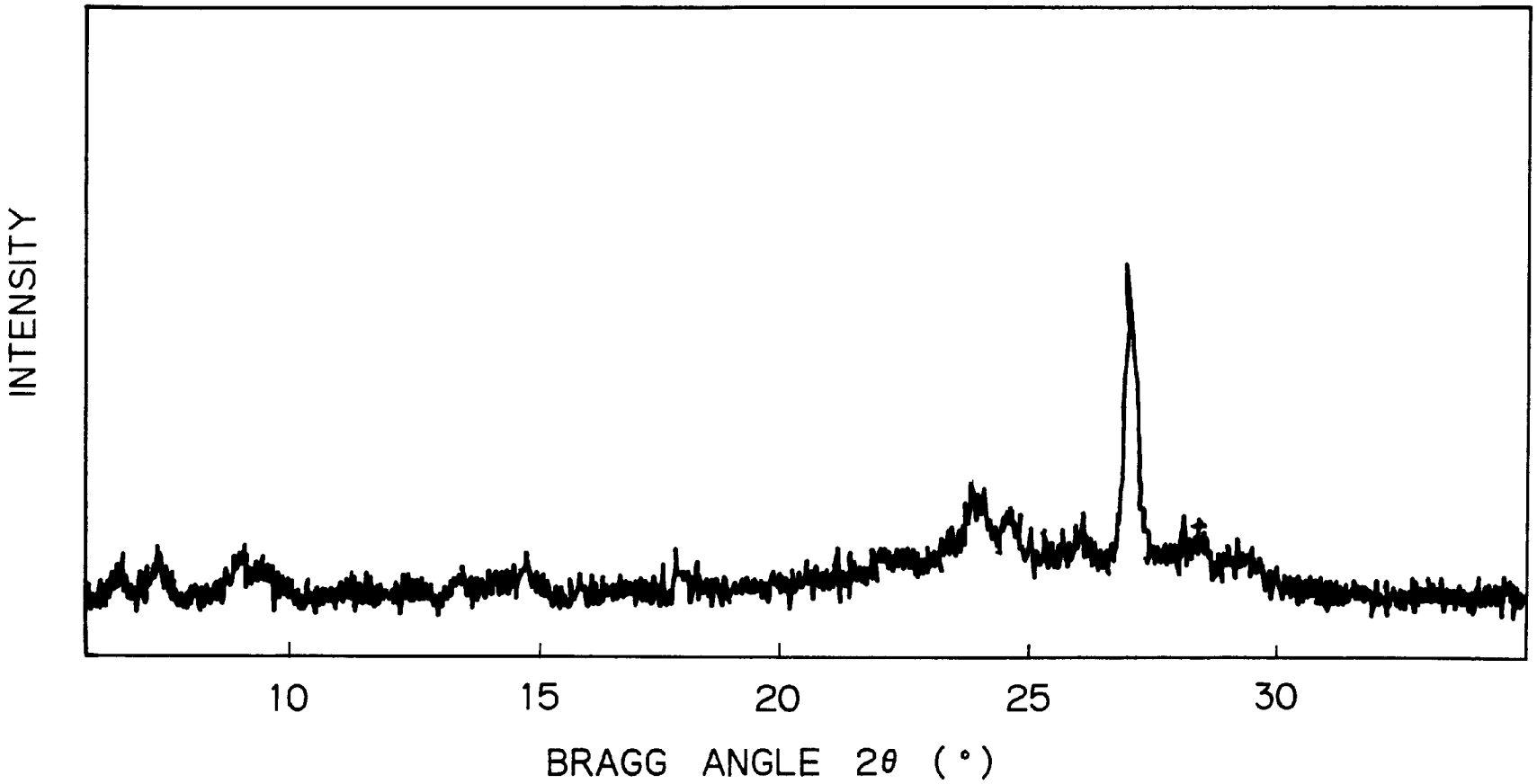
FIG. 5 shows an X-ray diffraction spectrum of the (A) phthalocyanine composition (III) prepared in Preparation Example 3.

140 g of ion-exchanged water and 50 g of toluene were added to 2 g of the dried precipitate (X), and the mixture was heated to 60 to 70° C. for 5 hours with stirring and then centrifuged. After removal of the supernatant, the separated solids were washed with methanol sufficiently, and then heated in vacuo to 60° C. for 4 hours to dry, to obtain crystals of a (A) phthalocyanine composition (III). An X-ray diffraction spectrum of the (A) phthalocyarnine composition (III) indicated major peaks at Bragg angles (2θ±0.2°) of 7.5°, 24.2° and 27.3°. FIG. 5 shows the X-ray diffraction spectrum.

Preparation Example 4

(Preparation of (A) phthalocyanine composition (IV))

A dried precipitate (X) was prepared by repeating the procedures of Steps-1 to 3 of Preparation Example 1. An X-ray diffraction spectrum of the dried precipitate (X) indicated a clear peak at a Bragg angle (2θ±0.2°) of 27.2°.

Figure 6:
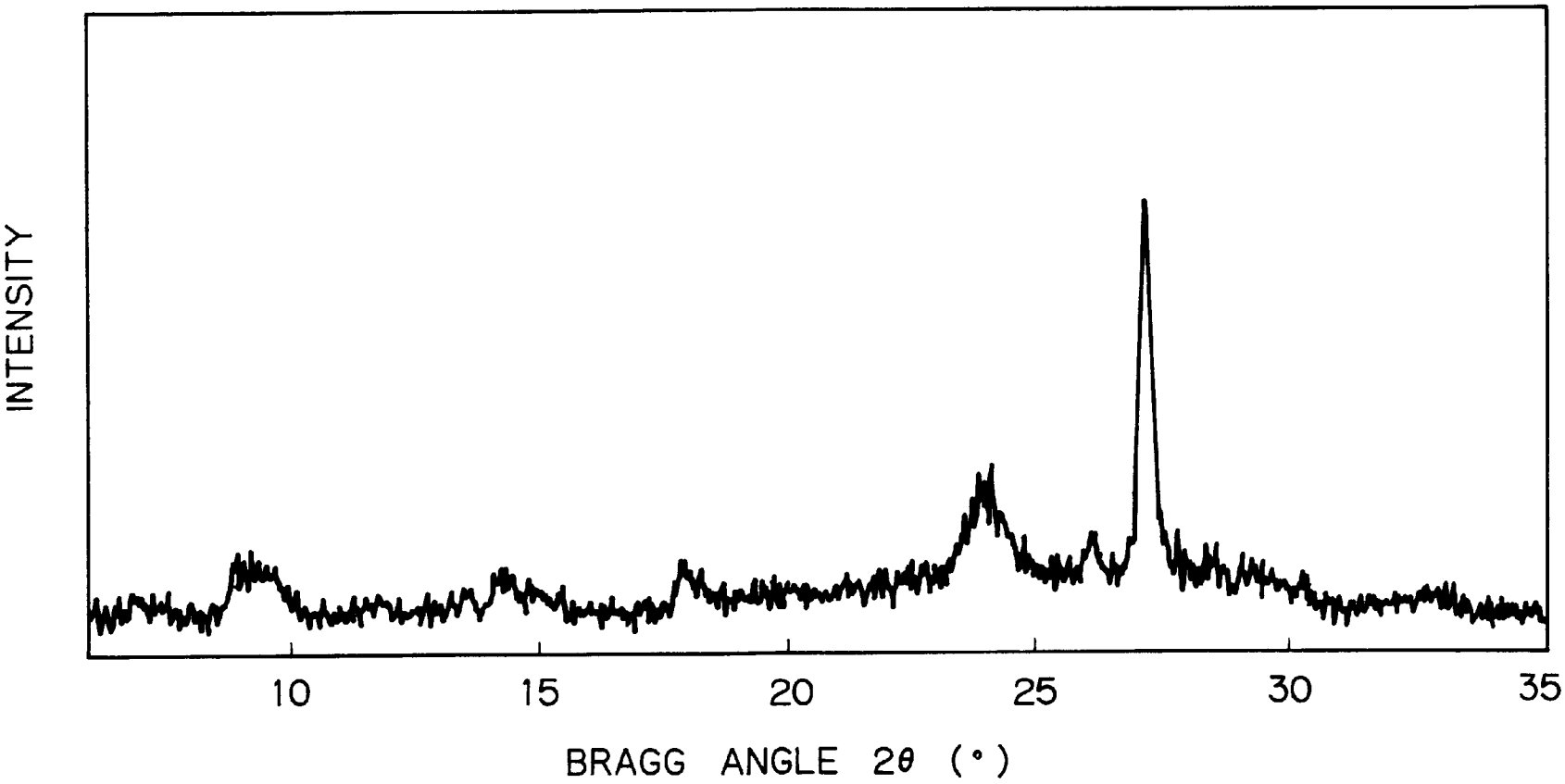
FIG. 6 shows an X-ray diffraction spectrum of the (A) phthalocyanine composition (IV) prepared in Preparation Example 4.

700 g of ion-exchanged water, 250 g of toluene and 1 Kg of zirconia beads of 1 mmϕ were added to 10 g of the dried precipitate (X), and the mixture was ground and heated to 60 to 70° C. for 5 hours with stirring. After cooling, filtration and centrifuging were carried out to remove the water and solvent. The separated solids were washed with methanol sufficiently, and then heated in vacuo to 60° C. for 4 hours to dry, to obtain crystals of a (A) phthalocyanine composition (IV). An X-ray diffraction spectrum of the (A) phthalocyanine composition (IV) indicated major peaks at Bragg angles (2θ±0.2°) of 17.9°, 24.0°, 26.29° and 27.2°. FIG. 6 shows the X-ray diffraction spectrum.

Preparation Example 5

(Preparation of charge generation layer coating solution (1))

1.5 g of the crystals of the (A) phthalocyanine composition (I) obtained in Preparation Example 1, 0.9 g of a polyvinylbutyral resin (Trade name: S-LEC BL-5, produced by Sekisui Chemical Co., Ltd.), 0.167 g of a melamine resin (Trade name: ML365, produced by Hitachi Chemical Company, Ltd., solid content: 60% by weight, solvent: 1-butanol, isobutanol and xylene), 50 g of 2-ethoxyethanol and 50 g of tetrahydrofuran were mixed and dispersed with a ball mill, to prepare a charge generation layer coating solution (1).

Preparation Example 6

(Preparation of charge generation layer coating solution (2))

The procedures in Preparation Example 5 were repeated except that the (A) phthalocyanine composition (II) obtained in Preparation Example 2 was used in place of the (A) phthalocyanine composition (I) obtained in Preparation Example 1, to prepare a charge generation layer coating solution (2).

Preparation Example 7

(Preparation of charge generation layer coating solution (3))

The procedures in Preparation Example 5 were repeated except that the (A) phthalocyanine composition (III) obtained in Preparation Example 3 was used in place of the (A) phthalocyanine composition (I) obtained in Preparation Example 1, to prepare a charge generation layer coating solution (3).

Preparation Example 8

(Preparation of charge generation layer coating solution (4))

The procedures in Preparation Example 5 were repeated except that the (A) phthalocyanine composition (IV) obtained in Preparation Example 4 was used in place of the (A) phthalocyanine composition (I) obtained in Preparation Example 1, to prepare a charge generation layer coating solution (4).

Example 1

(Preparation of charge transport layer coating solution (1))

15 g of the above-exemplified (B) benzidine derivative No. 3, 15 g of a polycarbonate copolymer (Trade name: B500, produced by Idemitsu Kosan Co., Ltd., number average molecular weight=50,000) and 130 g of tetrahydrofuran were mixed and dissolved uniformly with a mechanical stirrer, to prepare a charge transport layer coating solution (1).

Example 2

(Preparation of charge transport layer coating solution (2))

The procedures in Example 1 were repeated except that the above-exemplified (B) benzidine derivative No. 4 was used in place of the (B) benzidine derivative No. 3, to prepare a charge transport layer coating solution (2).

Example 3

(Preparation of charge transport layer coating solution (3))

The procedures in Example 1 were repeated except that the above-exemplified (B) benzidine derivative No. 7 was used in place of the (B) benzidine derivative No. 3, to prepare a charge transport layer coating solution (3).

Comparative Example 1

(Preparation of charge transport layer coating solution ①)

The procedures in Example 1 were repeated except that the following butadiene derivative T-1 was used in place of the (B) benzidine derivative No. 3, to prepare a charge transport layer coating solution ①.

(T-1)

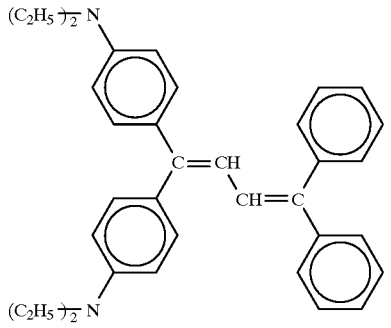

Comparative Example 2

(Preparation of charge transport layer coating solution ②)

The procedures in Example 1 were repeated except that the following benzidine derivative T-2 was used in place of the (B) benzidine derivative No. 3, to prepare a charge transport layer coating solution ②.

(T-2)

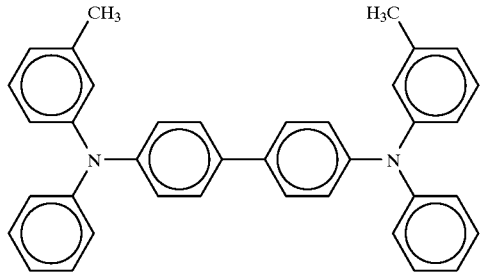

Comparative Example 3

(Preparation of charge transport layer coating solution ③)

The procedures in Example 1 were repeated except that the following fluorine-containing benzidine derivative T-3 was used in place of the (B) benzidine derivative No. 3, to prepare a charge transport layer coating solution ③.

(T-3)

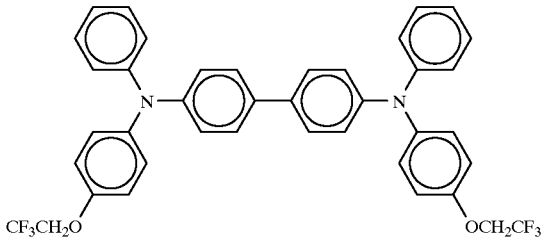

Example 4

(Production of electrophotographic photoreceptor (A))

<Formation of undercoating layer>

A coating solution was prepared by dissolving 26.6 parts by weight of an alcohdl-soluble polyamide resin (Trade name: M1276, produced by Nippon Rirusan Co., Ltd.), 52.3 parts by weight of a melamine resin (Trade name: ML2000, produced by Hitachi Chemical Company, Ltd., solid content: 50% by weight, solvent: 1-butanol, xylene and formaldehyde) and 2.8 parts by weight of trimellitic anhydride (produced by Wakoh Jun-yaku Kogyo Co., Ltd.) in 620 parts by weight of ethanol and 930 parts by weight of 1,1,2-trichloroethane.

The coating solution was applied-to an aluminum plate (conductive support, 10 mm×100 mm×0.1 mm) by a dipping method, and dried at 140° C. for 30 minutes, to form an undercoating layer of 0.3 μm thick.

<Formation of charge generation layer>

The charge generation layer coating solution (1) prepared in Preparation Example 5 was applied to the undercoating layer on the aluminum support by a dipping method, and dried at 120° C. for 30 minutes, to form a charge generation layer of 0.2 μm thick.

<Formation of charge transport layer>

The charge transport layer coating solution (1) prepared in Example 1 was applied to the charge generation layer over the aluminum support, and dried at 120° C. for 30 minutes, to form a charge transport layer of 23 μm thick. Thus, an electrophotographic photoreceptor (A) was produced.

The electrophotographic photoreceptor (A) was tested for electrophotographic properties (sensitivity, residual potential, dark decay ratio), and the results are shown in Table 1.

Measurements of the electrophotographic properties were carried out with a CYNTHIA 30HC (produced by Midoriya Denki Co., Ltd.) by charging the electrophotographic photoreceptor to −650 V and then exposing it to a monochromatic light of 780 nm for 25 ms according to a corona charging method.

The above described properties are defined as follows.

Sensitivity ($E_{1/2}$): the energy (mJ/m$^2$) of the irradiated monochromatic light of 780 nm necessary to reduce an initial charged potential of −650 V to half at 0.2 seconds after exposure.

Residual potential ($VL_t$): the potential (−V) remaining on the surface of the electrophotographic photoreceptor at t seconds after exposure to a monochromatic light of the same wave length and an energy of 20 mJ/m$^2$ Dark decay ratio ($DDR_t$): a value obtained from an initial harged potential −650 V and a surface potential $V_t$ (−V) at t seconds after standing in the dark after the initial charging by using an equation of $DDR_t=(V_t/650)\times100(\%)$ Example 5

(Production of electrophotographic photoreceptor (B))

An electrophotographic photoreceptor (B) was produced in the same manner as in Example 4 except that the charge generation layer coating solution (2) prepared in Preparation Example 6 was used in place of the charge generation layer coating solution (1) prepared in Preparation Example 5.

The electrophotographic photoreceptor (B) was tested for electrophotographic properties (sensitivity, residual potential, dark decay ratio) in the same manner as in Example 4. The results are shown in Table 1.

Example 6

(Production of electrophotographic photoreceptor (C))

An electrophotographic photoreceptor (C) was produced in the same manner as in Example 4 except that the charge generation layer coating solution (3) prepared in Preparation Example 7 was used in place of the charge generation layer coating solution (1) prepared in Preparation Example 5.

The electrophotographic photoreceptor (C) was tested for electrophotographic properties (sensitivity, residual potential, dark decay ratio) in the same manner as in Example 4. The results are shown in Table 1.

Example 7

(Production of electrophotographic photoreceptor (D))

An electrophotographic photoreceptor (D) was produced in the same manner as in Example 4 except that the charge generation layer coating solution (4) prepared in Preparation Example 8 was used in place of the charge generation layer coating solution (1) prepared in Preparation Example 5.

The electrophotographic photoreceptor (D) was tested for electrophotographic properties (sensitivity, residual potential, dark decay ratio) in the same manner as in Example 4. The results are shown in Table 1.

Example 8

(Production of electrophotographic photoreceptor (E))

An electrophotographic photoreceptor (E) was produced in the same manner as in Example 6 except that the charge transport layer coating solution (2) prepared in Example 2 was used in place of the charge transport layer coating solution (1) prepared in Example 1.

The electrophotographic photoreceptor (E) was tested for electrophotographic properties (sensitivity, residual potential, dark decay ratio) in the same manner as in Example 4. The results are shown in Table 1.

Example 9

(Production of electrophotographic photoreceptor (F))

An electrophotographic photoreceptor (F) was produced in the same manner as in Example 6 except that the charge transport layer coating solution (3) prepared in Example 3 was used in place of the charge transport layer coating solution (1) prepared in Example 1.

The electrophotographic photoreceptor (F) was tested for electrophotographic properties (sensitivity, residual potential, dark decay ratio) in the same manner as in Example 4. The results are shown in Table 1.

Example 10

(Production of electrophotographic photoreceptor (G))

An electrophotographic photoreceptor (G) was produced in the same manner as in Example 7 except that the charge transport layer coating solution (2) prepared in Example 2 was used in place of the charge transport layer coating solution (1) prepared in Example 1.

The electrophotographic photoreceptor (G) was tested for electrophotographic properties (sensitivity, residual potential, dark decay ratio) in the same manner as in Example 4. The results are shown in Table 1.

Example 11

(Production of electrophotographic photoreceptor (H))

An electrophotographic photoreceptor (H) was produced in the same manner as in Example 7 except that the charge transport layer coating solution (3) prepared in Example 3 was used in place of the charge transport layer coating solution (1) prepared in Example 1.

The electrophotographic photoreceptor (H) was tested for electrophotographic properties (sensitivity, residual potential, dark decay ratio) in the same manner as in Example 4. The results are shown in Table 1.

Comparative Example 4

(Production of electrophotographic photoreceptor (a))

An electrophotographic photoreceptor (a) was produced in the same manner as in Example 6 except that the charge transport layer coating solution ① prepared in Comparative Example 1 was used in place of the charge transport layer coating solution (1) prepared in Example 1.

The electrophotographic photoreceptor (a) was tested for electrophotographic properties (sensitivity, residual potential, dark decay ratio) in the same manner as in Example 4. The results are shown in Table 1.

Comparative Example 5

(Production of electrophotographic photoreceptor (b))

An electrophotographic photoreceptor (b) was produced in the same manner as in Example 6 except that the charge transport layer coating solution ② prepared in Comparative Example 2 was used in place of the charge transport layer coating solution (1) prepared in Example 1.

The electrophotographic photoreceptor (b) was tested for electrophotographic properties (sensitivity, residual potential, dark decay ratio) in the same manner as in Example 4. The results are shown in Table 1.

Comparative Example 6

(Production of electrophotographic photoreceptor (c))

An electrophotographic photoreceptor (c) was produced in the same manner as in Example 6 except that the charge transport layer coating solution ③ prepared in Comparative Example 3 was used in place of the charge transport layer coating solution (1) prepared in Example 1.

The electrophotographic photoreceptor (c) was tested for electrophotographic properties (sensitivity, residual potential, dark decay ratio) in the same manner as in Example 4. The results are shown in Table 1.

Comparative Example 7

(Production of electrophotographic photoreceptor (d))

An electrophotographic photoreceptor (d) was produced in the same manner as in Example 7 except that the charge transport layer coating solution ① prepared in Comparative Example 1 was used in place of the charge transport layer coating solution (1) prepared in Example 1.

The electrophotographic photoreceptor (d) was tested for electrophotographic properties (sensitivity, residual potential, dark decay ratio) in the same manner as in Example 4. The results are shown in Table 1.

Comparative Example 8

(Production of electrophotographic photoreceptor (e))

An electrophotographic photoreceptor (e) was produced in the same manner as in Example 7 except that the charge transport layer coating solution ② prepared in Comparative Example 2 was used in place of the charge transport layer coating solution (1) prepared in Example 1.

The electrophotographic photoreceptor (e) was tested for electrophotographic properties (sensitivity, residual potential, dark decay ratio) in the same manner as in Example 4. The results are shown in Table 1.

Comparative Example 9

(Production of electrophotographic photoreceptor (f))

An electrophotographic photoreceptor (f) was produced in the same manner as in Example 7 except that the charge transport layer coating solution ③ prepared in Comparative Example 3 was used in place of the charge transport layer coating solution (1) prepared in Example 1.

The electrophotographic photoreceptor (f) was tested for electrophotographic properties (sensitivity, residual potential, dark decay ratio) in the same manner as in Example 4. The results are shown in Table 1.

TABLE 1

| | Electro-photographic photoreceptor | Charge generation material | Charge transport material | Sensitivity ($E_{1/2}$) ($mJ/m^2$) | Residual potential ($VL_{0.1}$) (−V) | Residual potential ($VL_{0.2}$) (−V) | Dark decay ratio ($DDR_1$) (%) | Dark decay ratio ($DDR_5$) (%) |
|---|---|---|---|---|---|---|---|---|
| Ex. 4 | (A) | Phthalocyanine Comp. (I) | No. 3 | 2.6 | 28 | 25 | 98.1 | 94.1 |
| Ex. 5 | (B) | Phthalocyanine Comp. (II) | No. 3 | 1.8 | 32 | 28 | 97.9 | 93.8 |
| Ex. 6 | (C) | Phthalocyanine Comp. (III) | No. 3 | 1.0 | 16 | 14 | 98.3 | 94.8 |
| Ex. 7 | (D) | Phthalocyanine Comp. (IV) | No. 3 | 1.0 | 19 | 18 | 98.9 | 96.0 |
| Ex. 8 | (E) | Phthalocyanine Comp. (III) | No. 4 | 1.1 | 19 | 15 | 98.1 | 94.4 |
| Ex. 9 | (F) | Phthalocyanine Comp. (III) | No. 7 | 1.1 | 25 | 19 | 98.5 | 94.7 |
| Ex. 10 | (G) | Phthalocyanine Comp. (IV) | No. 4 | 1.0 | 22 | 18 | 98.4 | 95.3 |
| Ex. 11 | (H) | Phthalocyanine Comp. (IV) | No. 7 | 1.0 | 27 | 25 | 98.6 | 95.8 |
| Comp. Ex. 4 | (a) | Phthalocyanine | T-1 | 1.4 | 32 | 18 | 96.2 | 88.5 |

TABLE 1-continued

| | Electro-photographic photoreceptor | Charge generation material | Charge transport material | Sensitivity ($E_{1/2}$) ($mJ/m^2$) | Residual potential ($VL_{0.1}$) (−V) | Residual potential ($VL_{0.2}$) (−V) | Dark decay ratio ($DDR_1$) (%) | Dark decay ratio ($DDR_5$) (%) |
|---|---|---|---|---|---|---|---|---|
| Comp. Ex. 5 | (b) | Comp. (III) Phthalocyanine | T-2 | 1.2 | 38 | 31 | 97.8 | 93.4 |
| Comp. Ex. 6 | (c) | Comp. (III) Phthalocyanine | T-3 | 1.2 | 72 | 53 | 98.0 | 93.9 |
| Comp. Ex. 7 | (d) | Comp. (III) Phthalocyanine | T-1 | 1.1 | 20 | 15 | 98.2 | 93.9 |
| Comp. Ex. 8 | (e) | Comp. (IV) Phthalocyanine | T-2 | 1.0 | 35 | 30 | 98.6 | 95.7 |
| Comp. Ex. 9 | (f) | Comp. (IV) Phthalocyanine | T-3 | 1.0 | 70 | 45 | 98.6 | 95.3 |

The results listed in Table 1 show that all the electrophotographic photoreceptors of the present invention (Examples 4 to 11) exhibited high sensitivity, low residual potential and good dark decay ratio.

The electrophotographic photoreceptor of Comparative Examples 4, 6 and 9 were inferior to those of the present invention since the electrophotographic photoreceptor of Comparative Example 4 exhibited a low dark decay ratio, and. the electrophotographic photoreceptors of Comparative Examples 6 and 9 exhibited high residual potential.

The electrophotographic photoreceptors of Comparative Examples 5, 7 and 8 were similar to those of Examples in the levels of electrophotographic properties listed in Table 1.

(Tests of electrophotographic photoreceptors for image quality and properties in repeated uses)

The electrophotographic photoreceptors produced in Examples 6 and 7 and Comparative Examples 5, 7 and 8 were tested for the changes in properties (charging efficiency, dark decay ratio, residual potential and image quality) in repeated uses by the following methods.

By using an apparatus for evaluating electrophotographic properties, CYNTHIA 99HC (trade name, produced by Jentech Co., Ltd.), a cycle of sequential procedures comprising (charging) →(measurement of dark decay ratio)→(discharging)→(charging)→(exposure and measurement of residual potential)→(discharging) were repeated to investigate the changes in properties during repeated uses. The results are listed in Tables 2 and 3.

Concretely speaking, each electrophotographic photoreceptor was charged to a charged potential ($V_0$) by applying a corona voltage of −5 kV, and a dark decay ratio ($DDR_1 = (V_1/V_0)\times 100$) was calculated from the initial potential ($V_0$) and a surface potential ($V_1$) after standing for 1 second in the dark.

After discharging, the electrophotographic photoreceptor was charged again by applying a corona voltage of −5 kV, and then exposed to a monochromatic light of 780 nm (20 $mJ/m^2$), to measure the residual potential ($VL_{0.2}$) remaining on the surface of the receptor at 0.2 seconds after exposure.

Image quality was evaluated from photographic fogging, black dots (black dot-like defects appearing in white solid prints) and white dots (white dot-like defects appearing in black solid prints) and image density of black solid prints by using an image evaluation apparatus (negative charging, reversal development system) at a surface potential of −700 V and a bias voltage of −600 V. Black dots and white dots were visually observed. Photographic fogging and image density of black solid prints were evaluated by using a Macbeth reflection densitometer (produced by a division of Kollmergen Corporation).

TABLE 2

| | Electro-photographic photoreceptor | Charge generation material | Charge transport material | Properties | Number of cycles 1 | 100 | 500 | 1,000 |
|---|---|---|---|---|---|---|---|---|
| Example 6 | (C) | Phthalocyanine Comp. (III) | No. 3 | $V_0$ (−V) | 655 | 655 | 650 | 640 |
| | | | | $DDR_1$ (%) | 98.3 | 98.0 | 97.8 | 97.6 |
| | | | | $VL_{0.2}$ (−V) | 16 | 15 | 15 | 14 |
| | | | | Black dots | No | No | No | No |
| | | | | White dots | No | No | No | No |
| | | | | Photographic fogging density | 0.09 | 0.09 | 0.09 | 0.10 |
| | | | | Black solid density | 1.48 | 1.48 | 1.47 | 1.46 |
| Example 7 | (D) | Phthalocyanine Comp. (IV) | No. 3 | $V_0$ (−V) | 655 | 655 | 650 | 650 |
| | | | | $DDR_1$ (%) | 98.9 | 98.8 | 98.7 | 98.6 |
| | | | | $VL_{0.2}$ (−V) | 19 | 18 | 18 | 17 |
| | | | | Black dots | No | No | No | No |
| | | | | White dots | No | No | No | No |
| | | | | Photographic fogging density | 0.08 | 0.08 | 0.08 | 0.08 |
| | | | | Black solid density | 1.48 | 1.48 | 1.47 | 1.47 |

TABLE 3

| | Electro-photographic photoreceptor | Charge generation material | Charge transport material | Properties | Number of cycles 1 | 100 | 500 | 1,000 |
|---|---|---|---|---|---|---|---|---|
| Comparative Example 5 | (b) | Phthalocyanine Comp. (III) | T-2 | $V_0$ (−V) | 650 | 645 | 640 | 630 |
| | | | | $DDR_1$ (%) | 97.8 | 96.7 | 95.5 | 94.0 |
| | | | | $VL_{0.2}$ (−V) | 31 | 33 | 35 | 35 |
| | | | | Black dots | Observed | Observed | Observed | Observed |
| | | | | White dots | No | Observed | Observed | Observed |
| | | | | Photographic fogging density | 0.11 | 0.12 | 0.15 | 0.20 |
| | | | | Black solid density | 1.45 | 1.45 | 1.43 | 1.40 |
| Comparative Example 7 | (d) | Phthalocyanine Comp. (IV) | T-1 | $V_0$ (−V) | 655 | 645 | 630 | 620 |
| | | | | $DDR_1$ (%) | 98.2 | 97.0 | 93.8 | 92.3 |
| | | | | $VL_{0.2}$ (−V) | 15 | 10 | 10 | 10 |
| | | | | Black dots | Observed | Observed | Observed | Observed |
| | | | | White dots | No | No | Observed | Observed |
| | | | | Photographic fogging density | 0.10 | 0.12 | 0.20 | 0.25 |
| | | | | Black solid density | 1.48 | 1.47 | 1.47 | 1.46 |
| Comparative Example 8 | (e) | Phthalocyanine Comp. (IV) | T-2 | $V_0$ (−V) | 655 | 650 | 645 | 635 |
| | | | | $DDR_1$ (%) | 98.6 | 97.8 | 97.1 | 96.3 |
| | | | | $VL_{0.2}$ (−V) | 30 | 32 | 34 | 38 |
| | | | | Black dots | Observed | Observed | Observed | Observed |
| | | | | White dots | No | No | Observed | Observed |
| | | | | Photographic fogging density | 0.10 | 0.11 | 0.14 | 0.18 |
| | | | | Black solid density | 1.46 | 1.46 | 1.45 | 1.44 |

The results listed in Tables 2 and 3 show that, even after repeated uses, the electrophotographic photoreceptors of the present invention (Examples 6 and 7) maintain high sensitivity, low residual potential and high dark decay ratios and are excellent in image quality.

The electrophotographic photoreceptors of Comparative Examples 5, 7 and 8 maintained to some degree their excellence in sensitivity, residual potential and dark decay ratio, but caused significant deterioration of image quality during repeated uses.

(Thermal analysis of charge transport layers)

Each of the charge transport layer coating solutions prepared in Example 1 and Comparative Example 2 was applied to an aluminum plate (conductive support, 10 mm×100 mm×0.1 mm) by a dipping method, and then dried at 120° C. for 30 minutes, to form a charge transport layer of 23 μm thick.

The charge transport layers were peeled from the aluminum plates, and thermally analyzed in the air at a temperature raising rate of 5° C./min with a differential scanning calorimeter, DSC-200 (produced by Seiko Electronic Industry Co., Ltd.).

Figure 7:
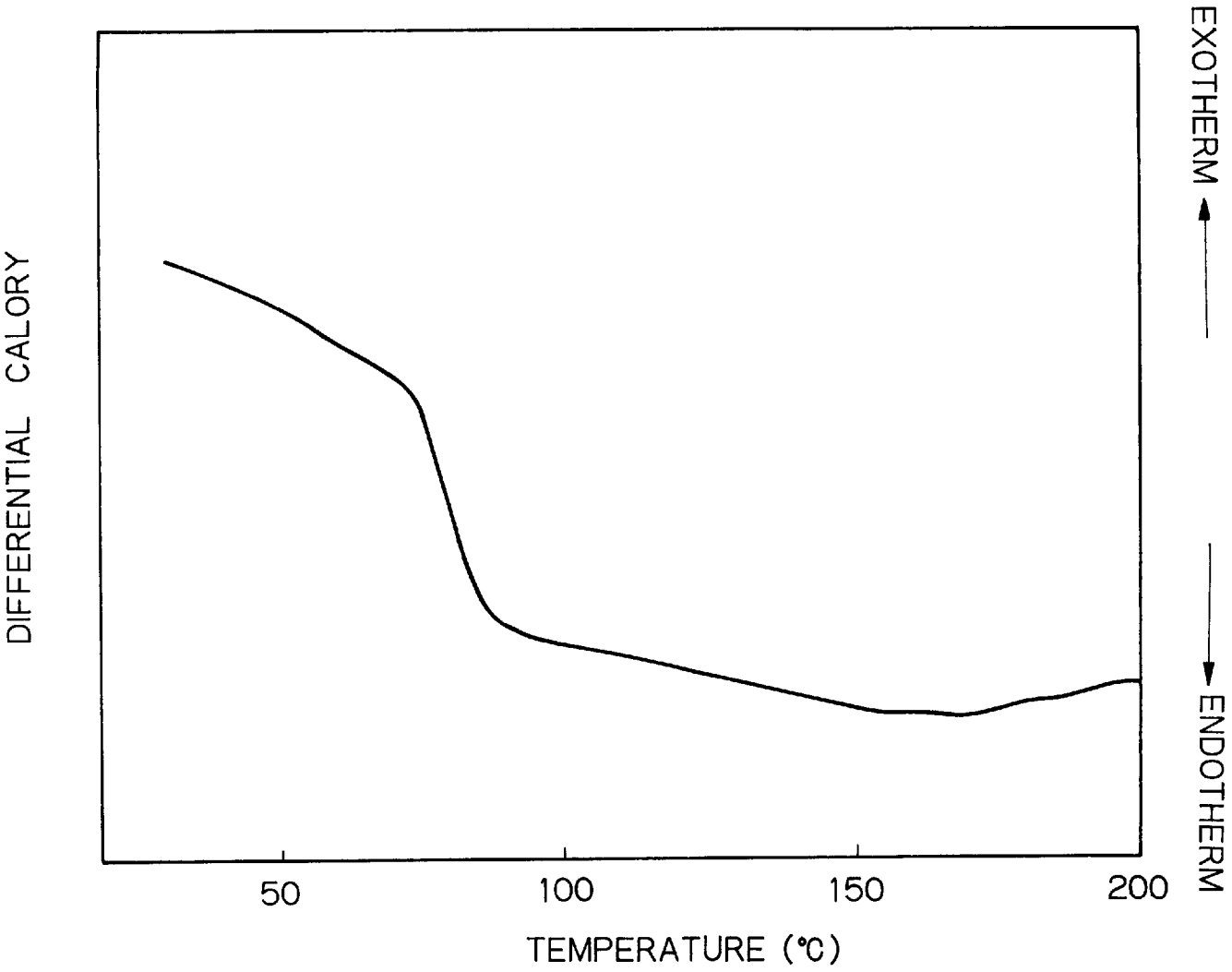
FIG. 7 shows data of an differential scanning calorimetric analysis of the charge transport layer which was produced from the charge transport layer coating solution prepared in Example 1.
Figure 8:
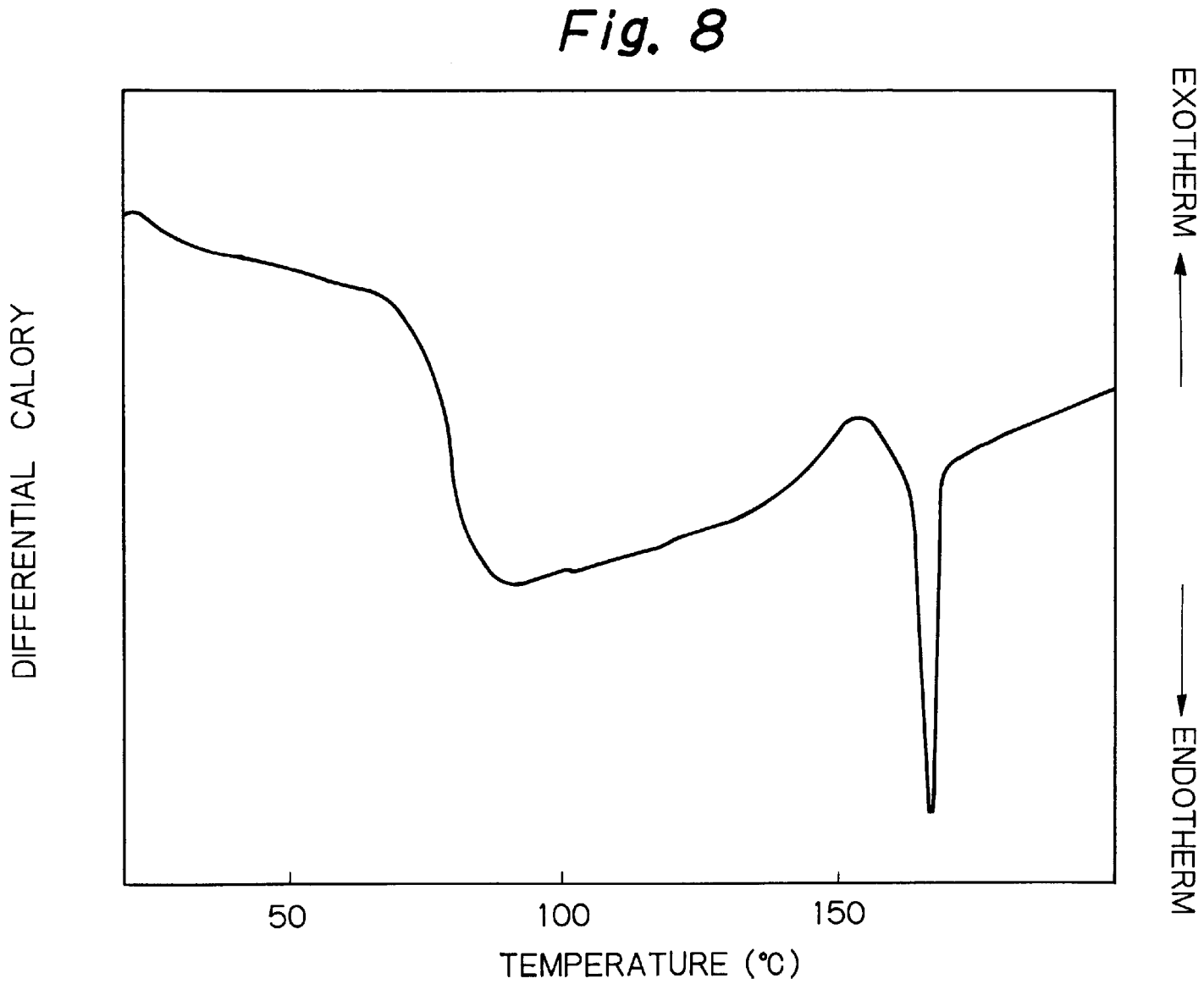
FIG. 8 shows data of an differential scanning calorimetric analysis of the charge transport layer which was produced from the charge transport layer coating solution prepared in Comparative Example 2.

FIG. 7 shows the data of the differential scanning calorimetric analysis of the charge transport layer which was formed from the charge transport layer coating solution prepared in Example 1, and FIG. 8 shows the data of the differential scanning calorimetric analysis of the charge transport layer which was formed from the charge transport layer coating solution prepared in Comparative Example 2.

As to the charge transport layer containing the (A) benzidine derivative (No. 3), FIG. 7 shows only one endothermic change which seems due to the glass transition of the charge transport layer, indicating that the charge transport layer did not suffer from phase separation of the (A) benzidine derivative (No. 3) therein.

As to the charge transport layer containing the benzidine derivative (T-2), FIG. 8 shows, in addition to an endothermic change indicating the glass transition of the charge transport layer, a sharp endothermic change which seems due to the benzidine derivative (T-2), thereby indicating that fine crystals of the benzidine derivative (T-2) were deposited in the charge transport layer.

Preparation Example 9

(Preparation of charge generation layer coating solution (5))

The procedures in Preparation Example 5 were repeated except that a mixture of 1.35 g of the (A) phthalocyanine composition (I) and 0.15 g of the (A) phthalocyanine composition (IV) was used in place of the (A) phthalocyanine composition (I) obtained in Preparation Example 1, to prepare a charge generation layer coating solution (5).

Preparation Example 10

(Preparation of charge generation layer coating solution (6))

The procedures in Preparation Example 5 were repeated except that a mixture of 0.75 g of the (A) phthalocyanine composition (I) and 0.75 g of the (A) phthalocyanine composition (IV) was used in place of the (A) phthalocyanine composition (I) obtained in Preparation Example 1, to prepare a charge generation layer coating solution (6).

Preparation Example 11

(Preparation of charge generation layer coating solution (7))

The procedures in Preparation Example 5 were repeated except that a mixture of 0.3 g of the (A) phthalocyanine composition (I) and 1.2 g of the (A) phthalocyanine composition (IV) was used in place of the (A) phthalocyanine composition (I) obtained in Preparation Example 1, to prepare a charge generation layer coating solution (7).

Example 12

(Production of electrophotographic photoreceptor (I))

An electrophotographic photoreceptor (I) was produced in the same manner as in Example 4 except that the charge generation layer coating solution (5) prepared in Preparation Example 9 was used in place of the charge generation layer coating solution (1) prepared in Preparation Example 5.

The electrophotographic photoreceptor (I) was tested for electrophotographic properties (sensitivity, residual potential, dark decay ratio) in the same manner as in Example 4. The results are shown in Table 4.

Example 13

(Production of electrophotographic photoreceptor (J))

An electrophotographic photoreceptor (J) was produced in the same manner as in Example 4 except that the charge generation layer coating solution (6) prepared in Preparation Example 10 was used in place of the charge generation layer coating solution (1) prepared in Preparation Example 5.

The electrophotographic photoreceptor (J) was tested for electrophotographic properties (sensitivity, residual potential, dark decay ratio) in the same manner as in Example 4. The results are shown in Table 4.

Example 14

(Production of electrophotographic photoreceptor (K))

An electrophotographic photoreceptor (K) was produced in the same manner as in Example 4 except that the charge generation layer coating solution (7) prepared in Preparation Example 11 was used in place of the charge generation layer coating solution (1) prepared in Preparation Example 5.

The electrophotographic photoreceptor (K) was tested for electrophotographic properties (sensitivity, residual potential, dark decay ratio) in the same manner as in Example 4. The results are shown in Table 4.

The results listed in Table 4 show that using mixtures of a phthalocyanine composition which has a CuKα-X-ray diffraction spectrum indicating major peaks at Bragg angles (2θ±0.2°) of 7.5°, 22.5°, 24.3°, 25.3° and 28.6° and a phthalocyanine composition which has a CuKα-X-ray diffraction spectrum indicating major peaks at Bragg angles (2θ±0.2°) of 17.9°, 24.0°, 26.2° and 27.2° as the phthalocyanine compositions (A) in charge generation layers enables adjustment of sensitivity to desired degrees, with low residual potential and good dark decay ratios maintained.

(Tests of Electrophotographic photoreceptors for image quality and Properties in repeated uses)

The electrophotographic photoreceptors produced in Examples 12, 13 and 14 were tested for the changes in properties (charging efficiency, dark decay ratio, residual potential and image quality) in repeated uses in the same manner as that employed for the electrophotographic photoreceptor produced in Example 6, by using an apparatus for evaluating electrophotographic properties, CYNTHIA 99HC (trade name, produced by Jentech Co., Ltd.). The results are shown in Table 5.

TABLE 4

| | Electro-photographic photoreceptor | Charge generation material | Charge transport material | Sensitivity ($E_{1/2}$) ($mJ/m^2$) | Residual potential ($VL_{0.1}$) (−V) | Residual potential ($VL_{0.2}$) (−V) | Dark decay ratio ($DDR_1$) (%) | Dark decay ratio ($DDR_5$) (%) |
|---|---|---|---|---|---|---|---|---|
| Example 12 | (I) | Phthalocyanine Comp. (I)/ Phthalocyanine Comp. (IV) = 90/10 (weight ratio) | No. 3 | 2.3 | 25 | 20 | 98.4 | 94.8 |
| Example 13 | (J) | Phthalocyanine Comp. (I)/ Phthalocyanine Comp. (IV) = 50/50 (weight ratio) | No. 3 | 1.6 | 22 | 19 | 98.6 | 95.5 |
| Example 14 | (K) | Phthalocyanine Comp. (I)/ Phthalocyanine Comp. (IV) = 20/80 (weight ratio) | No. 3 | 1.2 | 19 | 18 | 98.8 | 95.8 |

TABLE 5

| | Electro-photographic photoreceptor | Charge generation material | Charge transport material | Properties | Number of cycles 1 | 100 | 500 | 1,000 |
|---|---|---|---|---|---|---|---|---|
| Example 12 | (I) | Phthalocyanine Comp. (I)/ Phthalocyanine Comp. (IV) = 90/10 (weight ratio) | No. 3 | $V_0$ (−V) | 655 | 655 | 650 | 645 |
| | | | | $DDR_1$ (%) | 98.4 | 98.2 | 98.0 | 97.8 |
| | | | | $VL_{0.2}$ (−V) | 20 | 18 | 17 | 17 |
| | | | | Black dots | No | No | No | No |
| | | | | White dots | No | No | No | No |
| | | | | Photographic fogging density | 0.09 | 0.09 | 0.09 | 0.09 |
| | | | | Black solid density | 1.48 | 1.48 | 1.47 | 1.47 |
| Example 13 | (J) | Phthalocyanine Comp. (I)/ Phthalocyanine Comp. (IV) = 50/50 (weight ratio) | No. 3 | $V_0$ (−V) | 655 | 655 | 650 | 650 |
| | | | | $DDR_1$ (%) | 98.6 | 98.5 | 98.4 | 98.2 |
| | | | | $VL_{0.2}$ (−V) | 19 | 18 | 18 | 17 |
| | | | | Black dots | No | No | No | No |
| | | | | White dots | No | No | No | No |
| | | | | Photographic fogging density | 0.08 | 0.08 | 0.08 | 0.08 |
| | | | | Black solid density | 1.48 | 1.48 | 1.47 | 1.47 |
| Example 14 | (K) | Phthalocyanine Comp. (I)/ Phthalocyanine Comp. (IV) = 20/80 (weight ratio) | No. 3 | $V_0$ (−V) | 655 | 655 | 650 | 650 |
| | | | | $DDR_1$ (%) | 98.8 | 98.6 | 98.6 | 98.5 |
| | | | | $VL_{0.2}$ (−V) | 18 | 16 | 16 | 16 |
| | | | | Black dots | No | No | No | No |
| | | | | White dots | No | No | No | No |
| | | | | Photographic fogging density | 0.08 | 0.08 | 0.08 | 0.08 |
| | | | | Black solid density | 1.48 | 1.48 | 1.47 | 1.47 |

The results listed in Table 5 show that the electrophotographic photoreceptors of the present invention (Examples 12, 13 and 14) exhibited low residual potential and high dark decay ratios and could be adjusted to a sensitivity of a desired degree and exhibited good image quality even when used repeatedly.

What is claimed is:

1. An electrophotographic photoreceptor comprising a conductive support and a photosensitive layer, the photosensitive layer comprising a charge generation layer containing a charge generation material and a charge transport layer containing a charge transport material, the charge generation material comprising a phthalocyanine composition (A) comprising a phthalocyanine, and the charge transport material comprising a benzidine derivative (B) represented by the following general formula (I)

(I)

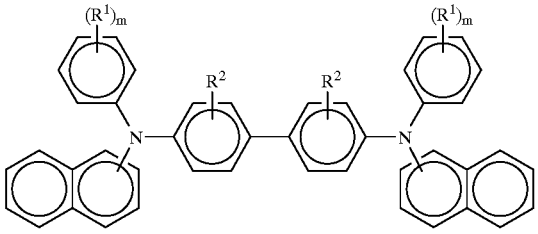

wherein each $R^1$ independently is a halogen atom, an alkyl group or an aryl group and is in an m- or p- position, each $R^2$ independently is hydrogen or an alkyl group, m is an integer of 1 to 3, and when the benzidine derivative (B) has two or more $R^1$ groups, the groups $R^1$ are identical with or different from each other.

2. The electrophotographic photoreceptor of claim 1 comprising in sequence a conductive support, a charge generation layer and a charge transport layer.

3. The electrophotographic photoreceptor of claim 1, wherein the phthalocyanine composition (A) comprises a phthalocyanine composition which is prepared by allowing a mixture comprising 20 to 95 parts by weight of titanyl phthalocyanine and 5 to 80 parts by weight of a halogenometal phthalocyanine containing a trivalent central metal selected from the group consisting of In, Ga and Al to precipitate in water by an acid-pasting method, and then crystallizing the precipitate by treating the precipitate in an organic solvent or a solvent mixture of an aromatic organic solvent and water.

4. The electrophotographic photoreceptor of claim 3, wherein the halogenometal phthalocyanine is chloroindium phthalocyanine.

5. The electrophotographic photoreceptor of claim 1, wherein the phthalocyanine composition (A) comprises a phthalocyanine composition (III) which has a CuKα-X-ray diffraction spectrum indicating major peaks at Bragg angles (2θ±0.2°) of 7.5°, 24.2° and 27.3°.

6. The electrophotographic photoreceptor of claim 5, wherein the phthalocyanine composition (III) is prepared by allowing a mixture of 20 to 95 parts by weight of a titanyl phthalocyanine and 5 to 80 parts by weight of a halogenometal phthalocyanine containing a trivalent central metal to precipitate in water by an acid-pasting method to obtain a precipitate which has a CuKα-X-ray diffraction spectrum indicating a major peak at a Bragg angle (2θ±0.2°) of 27.2°, and then crystallizing the precipitate by stirring the precipitate at 40 to 100° C. in a solvent mixture of an aromatic organic solvent and water.

7. The electrophotographic photoreceptor of claim 6, wherein the halogenometal phthalocyanine is chloroindium phthalocyanine.

8. The electrophotographic photoreceptor of claim 1, wherein the phthalocyanine composition (A) comprises a phthalocyanine composition (IV) which has a CuKα-X-ray diffraction spectrum indicating major peaks at Bragg angles (2θ±0.2°) of 17.9°, 24.0°, 26.2° and 27.2°.

9. The electrophotographic photoreceptor of claim 8, wherein the phthalocyanine composition (IV) is prepared by allowing a mixture of 20 to 95 parts by weight of a titanyl phthalocyanine and 5 to 80 parts by weight of a halogenometal phthalocyanine containing a trivalent central metal to precipitate in water by an acid-pasting method to obtain a precipitate which has a CuKα-X-ray diffraction spectrum indicating a major peak at a Bragg angle (2θ±0.2°) of 27.2°, and then crystallizing the precipitate by grinding the precipitate at 40 to 100° C. in a solvent mixture of an aromatic organic solvent and water.

10. The electrophotographic photoreceptor of claim 9, wherein the halogenometal phthalocyanine is chloroindium phthalocyanine.

11. The electrophotographic photoreceptor of claim 1, wherein the phthalocyanine composition (A) comprises a phthalocyanine composition (I) which has a CuKα-X-ray diffraction spectrum indicating major peaks at Bragg angles (2θ±0.2°) of 7.5°, 22.5°, 24.3°, 25.3° and 28.6°.

12. The electrophotographic photoreceptor of claim 11, wherein the phthalocyanine composition (I) is prepared by allowing a mixture of 20 to 95 parts by weight of a titanyl phthalocyanine and 5 to 80 parts by weight of a halogenometal phthalocyanine containing a trivalent central metal to precipitate in water by an acid-pasting method to obtain a precipitate which has a CuKα-X-ray diffraction spectrum indicating a major peak at a Bragg angle (2θ±0.2°) of 27.2°, and then crystallizing the precipitate by stirring the precipitate at 80 to 150° C. in an organic solvent.

13. The electrophotographic photoreceptor of claim 12, wherein the halogenometal phthalocyanine is chloroindium phthalocyanine.

14. The electrophotographic photoreceptor of claim 1, wherein the phthalocyanine composition (A) comprises a phthalocyanine composition (I) which has a CuKα-X-ray diffraction spectrum indicating major peaks at Bragg angles (2θ±0.2°) of 7.5°, 22.5°, 24.3°, 25.3° and 28.6° and a phthalocyanine composition (IV) which has a CuKα-X-ray diffraction spectrum indicating major peaks at Bragg angles (2θ±0.2°) of 17.9°, 24.0°, 26.2° and 27.2°.

15. The electrophotographic photoreceptor of claim 14, wherein the phthalocyanine composition (I) is prepared by allowing a mixture of 20 to 95 parts by weight of a titanyl phthalocyanine and 5 to 80 parts by weight of a halogenometal phthalocyanine containing a trivalent central metal to precipitate in water by an acid-pasting method to obtain a precipitate which has a CuKα-X-ray diffraction spectrum indicating a major peak at a Bragg angle (2θ±0.2°) of 27.2°, and then crystallizing the precipitate by stirring the precipitate at 80 to 150° C. in an organic solvent, and the phthalocyanine composition (IV) is prepared by allowing a mixture of 20 to 95 parts by weight of a titanyl phthalocyanine and 5 to 80 parts by weight of a halogenometal phthalocyanine containing a trivalent central metal to precipitate in water by an acid-pasting method to obtain a precipitate which has a CuKα-X-ray diffraction spectrum indicating a major peak at a Bragg angle (2θ±0.2°) of 27.2°, and then crystallizing the precipitate by grinding the precipitate at 40 to 100° C. in a solvent mixture of an aromatic organic solvent and water.

16. The electrophotographic photoreceptor of claim 15, wherein the halogenometal phthalocyanine is chloroindium phthalocyanine.

17. The electrophotographic photoreceptor of claim 1, wherein the phthalocyanine composition (A) comprises a phthalocyanine composition (II) which has a CuKα-X-ray diffraction spectrum indicating major peaks at Bragg angles (2θ±0.2°) of 9.3°, 13.1°, 15.0° and 26.2°.

18. The electrophotographic photoreceptor of claim 17, wherein the phthalocyanine composition (II) is prepared by allowing a mixture of 20 to 95 parts by weight of a titanyl phthalocyanine and 5 to 80 parts by weight of a halogenometal phthalocyanine containing a trivalent central metal to precipitate in water by an acid-pasting method, and then crystallizing the precipitate by stirring the precipitate at 80 to 150° C. in an organic solvent.

19. The electrophotographic photoreceptor of claim 18, wherein the halogenometal phthalocyanine is chloroindium phthalocyanine.

20. The electrophotographic photoreceptor of claim 1, wherein the charge generation layer comprises the phthalocyanine composition (A) and a binder, and the charge transport layer comprises the benzidine derivative (B) and a binder.

21. The electrophotographic photoreceptor of claim 1, wherein the benzidine derivative (B) is selected from the group consisting of the compounds represented by the following formulae:

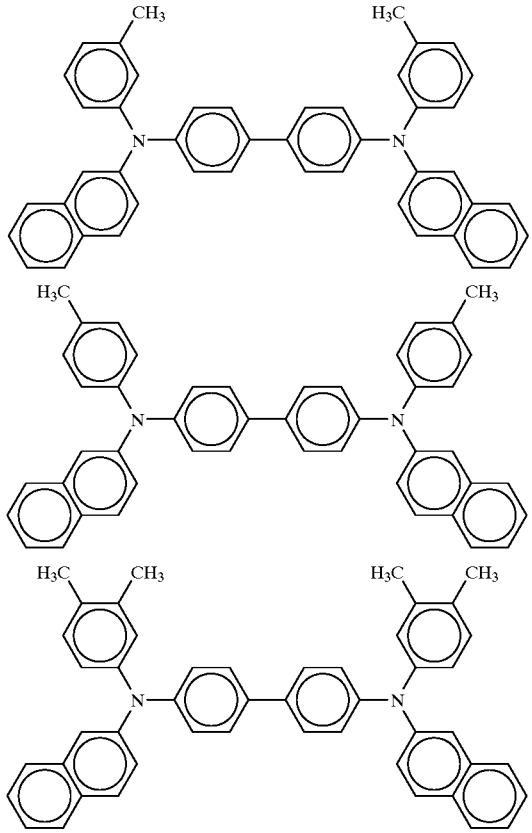

22. The electrophotographic photoreceptor of claim 1, wherein m is an integer of 1 or 2, and $R^1$ is an alkyl group.

23. The electrophotographic photoreceptor of claim 1, wherein the benzidine derivative (B) is selected from the group consisting of the benzidine derivatives represented by the following formulae

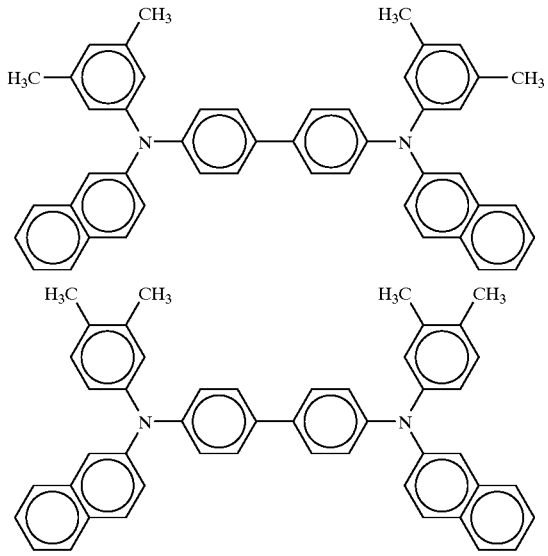

-continued
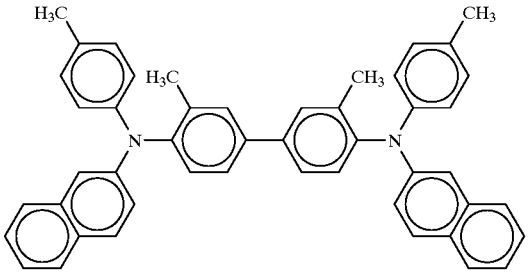
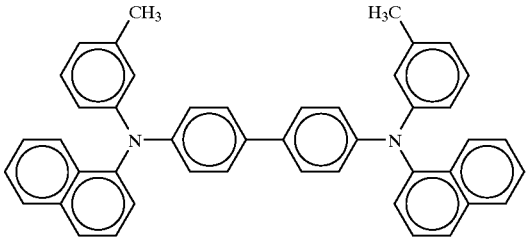
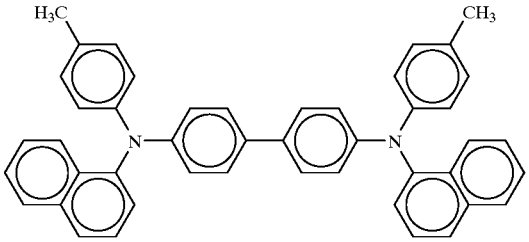
-continued
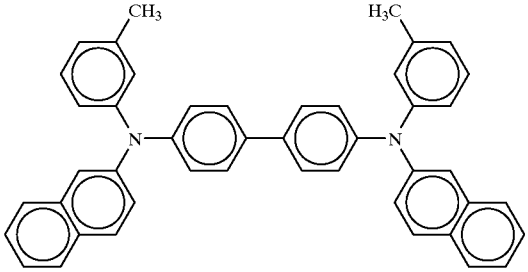
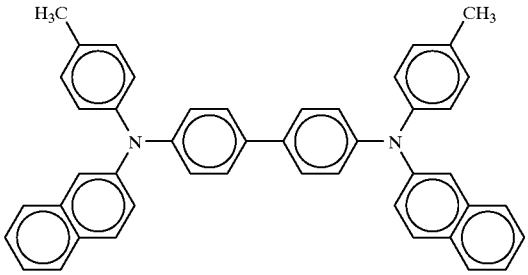
* * * * *